US007217050B2

(12) United States Patent
Kurashina et al.

(10) Patent No.: US 7,217,050 B2
(45) Date of Patent: May 15, 2007

(54) TAPE PROCESSING APPARATUS, METHOD OF PROCESSING TAPE IN TAPE PROCESSING APPARATUS, AND PROGRAM

(75) Inventors: Hiroyasu Kurashina, Matsumoto (JP); Junichi Kikuchi, Saitama (JP); Takayuki Uehara, Koshigaya (JP); Makoto Takada, Shiojiri (JP); Seiji Tanaka, Toyoshina-machi (JP); Takanobu Kameda, Tokyo (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 11/112,685

(22) Filed: Apr. 22, 2005

(65) Prior Publication Data

US 2005/0238404 A1 Oct. 27, 2005

(30) Foreign Application Priority Data

Apr. 22, 2004 (JP) ..... 2004-126744
Jul. 14, 2004 (JP) ..... 2004-207424
Feb. 22, 2005 (JP) ..... 2005-046219

(51) Int. Cl.
*B41J 11/00* (2006.01)

(52) U.S. Cl. ..... 400/621; 101/4; 101/127; 400/129; 400/127; 400/109.1

(58) Field of Classification Search ..... 101/4, 101/127; 400/621, 129, 127, 109.1
See application file for complete search history.

(56) References Cited

U.S. PATENT DOCUMENTS 5,627,578 A * 5/1997 Weintraub ..... 347/101
5,639,540 A * 6/1997 Imaeda ..... 428/195.1
5,779,482 A * 7/1998 Fukumoto ..... 434/113
6,086,273 A * 7/2000 Hong ..... 400/109.1
6,149,325 A * 11/2000 Nunokawa et al. ..... 400/208
6,585,438 B2 * 7/2003 Hosokawa et al. ..... 400/621
6,648,532 B2 * 11/2003 Furuya et al. ..... 400/621

FOREIGN PATENT DOCUMENTS

| | | |
|---|---|---|
| EP | 0 693 384 | 3/1998 |
| JP | 08-025785 | 1/1996 |
| JP | 10-275206 | 10/1998 |
| JP | 2001-088358 | 4/2001 |
| JP | 2001088358 A * | 4/2001 |

* cited by examiner

*Primary Examiner*—Ren Yan
*Assistant Examiner*—Matthew G Marini
(74) *Attorney, Agent, or Firm*—Hogan & Hartson LLP

(57) ABSTRACT

Before embossing raised letters on a target tape which is subjected to embossing of raised letters, written letters are printed based on inputted character information, and also an upside-and-downside identifying information for identifying the upside and the downside of the target tape as seen in the widthwise direction thereof is printed on the target tape. In the emboss-processing section, the upside and the downside of the target tape is detected based on the identifying information. If the target tape is found to have been inserted upside down, the raised letters are embossed in a state of turning the embossing data by 180 degrees.

2 Claims, 16 Drawing Sheets

FIRST PROCESSING MODE:WRITTEN-LETTER PRINTING →RAISED-LETTER EMBOSSING

SECOND PROCESSING MODE:ONLY WRITTEN-LETTER PRINTING

THIRD PROCESSING MODE:ONLY RAISED-LETTER EMBOSSING

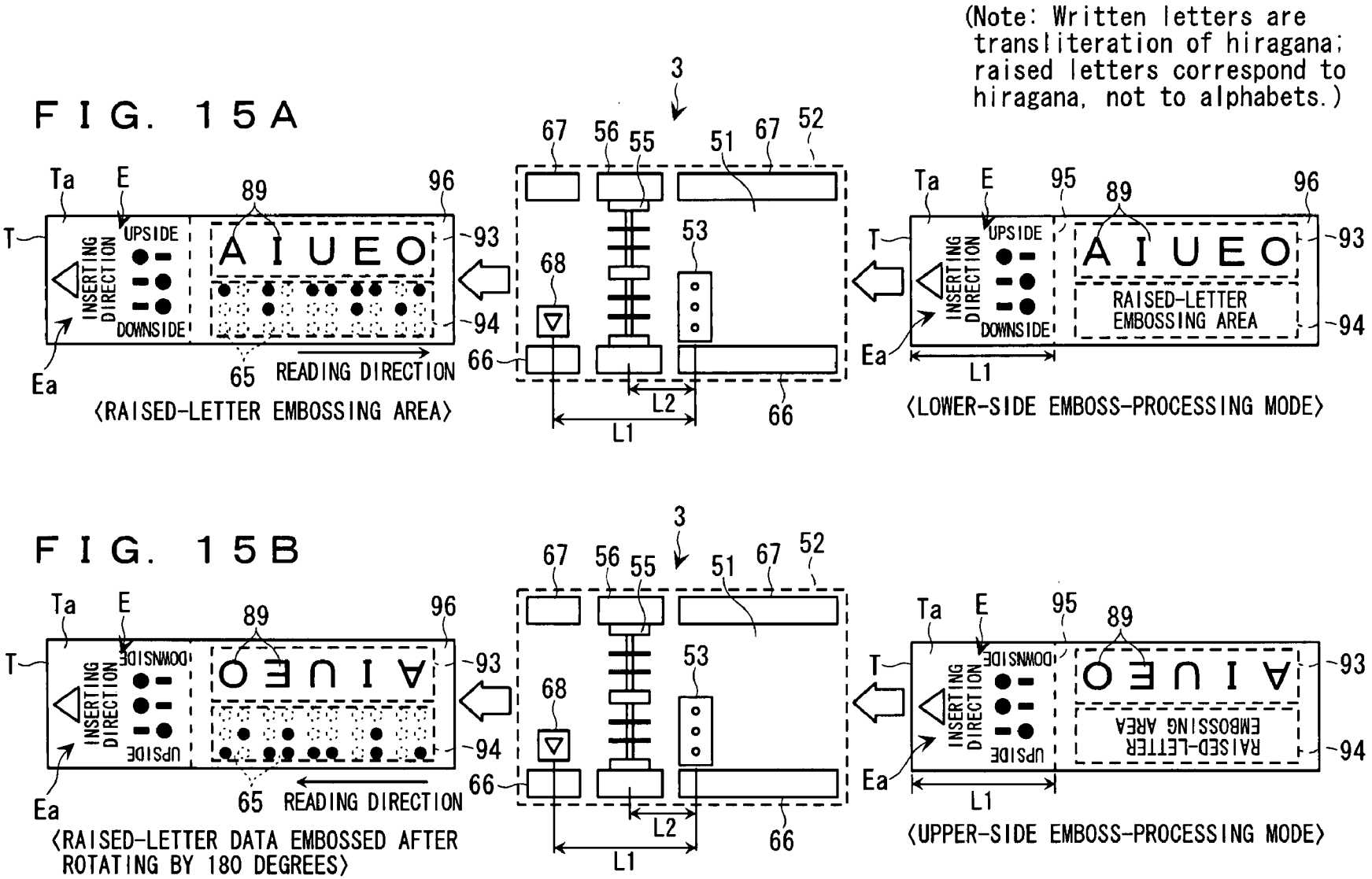
(Note: Written letters are transliteration of hiragana; raised letters correspond to hiragana, not to alphabets.)
FIG. 15A
FIG. 15B
AIUEO
RAISED-LETTER EMBOSSING AREA
INSERTING DIRECTION
UPSIDE
DOWNSIDE
READING DIRECTION
<RAISED-LETTER EMBOSSING AREA>
<LOWER-SIDE EMBOSS-PROCESSING MODE>
<UPPER-SIDE EMBOSS-PROCESSING MODE>
<RAISED-LETTER DATA EMBOSSED AFTER ROTATING BY 180 DEGREES>
T
Ta
E
Ea
L1
L2
3
51
52
53
55
56
65
66
67
68
89
93
94
95
96

PIOR ART

PIOR ART

TAPE PROCESSING APPARATUS, METHOD OF PROCESSING TAPE IN TAPE PROCESSING APPARATUS, AND PROGRAM

BACKGROUND OF THE INVENTION

1. Field of the Invention

This invention relates to: a tape processing apparatus in which written letters are also printed on a target tape together with raised letters (Braille); a method of processing a target tape in the tape processing apparatus; and a program. In this specification, the term "written letters" means letters printed in ink or the like as compared with embossed raised letters, and the term "target tape" means a tape which is made an object (or target) of processing such as printing, embossing, or the like.

2. Description of the Related Art

Conventionally, there is known a tape processing apparatus which prints and embosses both the raised letters and written letters on a target tape so that a person having an ordinary eyesight can understand the meaning of the raised letters. The apparatus is made up of: feeding means for feeding the target tape; printing means having a thermal head for printing the written letters; and embossing means having a plurality of embossing pins for embossing the raised letters. This tape processing apparatus performs the following operations, i.e., raised letters are embossed by the embossing means in the lower half of the target tape, and written letters are printed by the printing means in the upper half of the target tape, thereby forming a target tape having raised letters and written letters in parallel with each other. In other words, in this tape processing apparatus, the embossing of the raised letters and the printing of the written letters are performed in parallel with each other while feeding the target tape.

There is also known a raised-letter label which is formed by the above-described kind of apparatus and is capable of being recognized by both those who are handicapped in eyesight and those who have ordinary eyesight.

This kind of conventional tape processing apparatus has the following problem. Namely, when the embossing means is operated, the target tape will get out of the thermal head due to the vibrations accompanied by the embossing operations, whereby the written-letter printing deteriorates in quality.

In order to eliminate this kind of problem, the following arrangement may be considered. Namely, the printing means and the embossing means are formed into separate members or disposed at a distance from each other. After having printed the written letters on the target tape by the printing means, the target tape is manually inserted into the embossing means to thereby emboss the raised letters (a so-called two-pass method in that the target tape is caused to pass through the apparatus twice).

If the printing process and the embossing process are performed in the above-described two-pass method, the following procedure becomes necessary. Namely, in case the raised letters are embossed on the upper half of the target tape and the written letters are printed on the lower half thereof, the target tape having printed thereon the written letters must be inverted upside down before manually inserting it into the apparatus, and the embossing must then be performed starting with the last word to come in the ordinary order of reading. The embossing from the last word can be performed easily through data processing, but there will occur a new problem in that the user may make a mistake in inserting the target tape into the embossing means in the wrong direction (upside-and-downside direction). It is to be noted that the user is likely to introduce the target tape into the embossing means in the same direction as the direction in which the target tape is discharged in the printing process.

In case the written letter printing has a content whose vertical (upside-and-downside) positional relationship cannot be judged as shown in FIG. 16A (e.g., an arrow mark, numeral zero, or the like), the user may sometimes make a mistake in the upside and the downside as seen in the widthwise direction of the target tape when the target tape having printed thereon the written letters. Further, in case only the raised-letter embossing is performed on the target tape without printing the written letters, the person having an ordinary eyesight has a difficulty in recognizing the upside and the downside of the label thus formed. Therefore, he or she may wrongly adhere the label upside down.

SUMMARY OF THE INVENTION

In view of the above problems, this invention has an advantage of providing a tape processing apparatus having the following features. Namely, in the apparatus in which a target tape having printed thereon written letters by printing means is manually inserted into embossing means, the apparatus makes it possible to perform embossing by implying the direction of manually inserting the target tape or, even if the user makes a mistake in the direction of insertion, makes it possible to emboss the raised letters normally or correctly. This invention further provides a method of processing a tape in the tape processing apparatus, as well as a program therefore.

According to one aspect of this invention, there is provided a tape processing apparatus comprising: a print-processing section having printing means for printing written-letter data on a target tape based on inputted character information; and an emboss-processing section into which is manually inserted the target tape upon print-processing. The emboss-processing section has embossing means for embossing raised-letter data on the target tape based on the character information. The printing means prints on the target tape upside-and-downside identifying information for identifying an upside and a downside of the target tape as seen in the widthwise direction thereof.

According to this arrangement, the written-letter data based on the inputted character information is printed by the printing means together with the upside-and-downside identifying information for identifying the upside and the downside of the target tape as seen in the widthwise direction of the target tape. At the time of manually inserting (by guiding) the target tape which has printed thereon the written letters, the user can confirm the upside-and-downside identifying information and, therefore, the tape can be prevented from being inserted upside down (i.e., in the wrong direction). Even in case the upside and the downside of the written letters cannot be recognized (e.g., an arrow mark, a numeral zero, or the like), a label thus formed can be prevented from being adhered upside down. It is also possible to perform written-letter printing and raised-letter embossing based not on the same character information but on different character information.

Preferably, the emboss-processing section comprises: information detection means for detecting the upside-and-downside identifying information of the inserted tape; upside-and-downside distinguishing means for distinguishing the upside and the downside of the target tape depending on a result of detection by the information detection means; and emboss-controlling means for controlling the embossing means, when the target tape is distinguished by the upside-and-downside distinguishing means to have been inserted upside down, to emboss the raised-letter data in a state of turning by 180 degrees.

According to this arrangement, the information detection means detects the upside and the downside of the inserted target tape. If the target tape is inserted upside down, the embossing is performed in a state of turning or rotating the raised-letter data by 180 degrees. Therefore, even if the target tape is inserted upside down, the embossing can be performed properly. The emboss-controlling means performs an ordinary embossing when the target tape is inserted into the emboss-processing section in a correct upside-and-downside posture (i.e., the raised letters are embossed in an ordinary direction without turning).

Preferably, the target tape is made up of a recording tape having coated an adhesive agent on a rear surface thereof, and a release tape having adhered to the rear surface of the recording tape through the adhesive agent. The print-processing section further comprises: full-cut means for full-cutting the target tape; and half-cut means for half-cutting only the recording tape of the target tape. The printing means prints the upside-and-downside identifying information at a waste margin of the target tape, the waste margin being formed by the half-cut means.

According to this arrangement, since the print-processing section is provided with the half-cut means, it is possible to form the waste margin on the target tape that is not half-cut in advance and, since the upside-and-downside identifying information is printed on the waste margin, the printing area for performing the written-letter printing thereon is prevented from getting damaged.

According to another aspect of this invention, there is provided a tape processing apparatus comprising: a print-processing section having printing means for printing on a written-letter printing area of a target tape; and an emboss-processing section into which is manually inserted the target tape upon print-processing. The emboss-processing section has embossing means for embossing raised letters on a raised-letter embossing area which lies on one widthwise side of the inserted target tape. The printing means prints on the target tape indicating information which indicates a direction of manual insertion such that the raised-letter embossing area of the manually inserted target tape and a position of disposing the embossing means coincide with each other.

According to still another aspect of this invention, there is provided a method of processing a tape in a tape processing apparatus, the apparatus comprising: a print-processing section having printing means for performing printing on a written-letter printing area of a target tape; and an emboss-processing section into which is manually inserted the target tape upon print-processing. The emboss-processing section has embossing means for performing embossing of raised letters in a raised-letter embossing area which lies on one widthwise side of the inserted target tape. The method comprises printing on the target tape indicating information which indicates the direction of manual insertion such that the raised-letter embossing area of the manually inserted target tape and a position of disposing the embossing means coincide with each other.

According to the above arrangements, the target tape has printed thereon the indicating information which indicates the direction of manually inserting the target tape. Therefore, this information can prevent the user from manually inserting the target tape into the emboss-processing section in the wrong direction. As a result, the user can obtain a target tape having correctly embossed the raised letters in the raised-letter embossing area.

Preferably, the target tape is made up of a recording tape having coated an adhesive agent on a rear surface thereof, and a release tape having adhered to the rear surface of the recording tape through the adhesive agent. The print-processing section further comprises: full-cut means for full-cutting the target tape; and half-cut means for half-cutting only the recording tape of the target tape. The printing means prints the indicating information at that waste margin of the target tape which is formed by the half-cut means.

According to this arrangement, the recording tape of the print-processed target tape can be adhered, through the adhesive agent, to an object of adhesion (an object to which the recording tape is to be adhered) as a label. In addition, the half-cut means makes it easy to peel the release tape off from the recording tape and, also, to form the waste margin which is not to be adhered to the object of adhesion. The indicating information is thus printed by the printing means on this waste margin. Therefore, the indicating information does not remain on the recording tape in a state in which the recording tape is used as a label.

Preferably, the half-cut means forms the waste margin on a front-end side as seen in the manually inserting direction of the target tape.

According to this arrangement, since the waste margin having printed thereon the indicating information is formed at the front end as seen in the direction of manual insertion of the target tape. Therefore, the target tape can be inserted into the emboss-processing section from the waste margin (with the indicating information positioned ahead), thereby further clarifying the direction of manual insertion.

According to still another aspect of this invention, there is provided a method of processing a tape in a tape processing apparatus by performing written-letter printing and raised-letter embossing on a target tape based on inputted character information. The method comprises, prior to embossing the raised letters, performing the written-letter printing on the target tape based on the character information and performing thereon printing of upside-and-downside identifying information for identifying an upside and a downside of the target tape as seen in the widthwise direction thereof.

According to this arrangement, the written-letter printing is performed based on the inputted character information and also the upside-and-downside identifying information for identifying the upside and the downside of the target tape as seen in the widthwise direction thereof is printed. Therefore, when the target tape which has printed thereon the written letters is inserted into the tape processing apparatus, the user can confirm the upside-and-downside identifying information, thereby preventing the target tape from being wrongly inserted upside down. Even in case the upside and the downside of the written-letter printing cannot be judged from the contents thereof (e.g., an arrow mark, numeral zero, or the like), the formed label can be prevented from being adhered upside down. The term "upside and downside of the target tape" is to be defined by the upside-and-downside identifying information and coincides with the upside and the downside of the raised letters at the time of performing the raised-letter embossing.

According to yet another aspect of this invention, there is provided a method of processing a tape in a tape processing apparatus by performing raised-letter embossing on a manually inserted target tape based on raised-letter data, the target tape having printed thereon upside-and-downside identifying information for identifying an upside and a downside of the target tape as seen in the widthwise direction thereof. The method comprises: detecting the upside and the downside of the target tape based on the upside-and-downside identifying information; and embossing the raised-letter data in a state of turning by 180 degrees when the target tape is inserted upside down.

According to this arrangement, the upside and the downside of the manually inserted target tape as seen in the widthwise direction thereof is detected. When the target tape is inserted upside down, the raised-letter data is embossed in a state of turning by 180 degrees. Therefore, even if the target tape is inserted upside down, the embossing of the raised letters can always be performed properly. In case the target tape is inserted correctly, embossing is performed in a usual or ordinary manner (i.e., in the normal direction of the raised-letter data without turning it).

Preferably, the emboss-processing section further comprises front-end detecting means for detecting a front end of the target tape which is to be fed while being embossed, the detection being made on a downstream side, as seen in the feeding direction, of said embossing means. The length of the waste margin is set to be substantially equal to a distance between the embossing means and the front-end detecting means.

According to this arrangement, while the target tape which is equivalent to the length between the embossing means and the detecting means will ordinarily be wasted when the embossing means performs control to start the embossing after the front end of the target tape has been detected by the detecting means, such wasting can be efficiently used to advantage by the above-described setting of the length of the waste margin.

According to yet another aspect of this invention, there is provided a program for causing a computer to function as each of the means in the above-described tape processing apparatus.

According to this arrangement, there can be provided a program for materializing a tape processing apparatus in which the target tape is inserted into the embossing section without mistaking the upside and the downside thereof.

BRIEF DESCRIPTION OF THE DRAWINGS

The above and other objects and the attendant features of this invention will become readily apparent by reference to the following detailed description when considered in conjunction with the accompanying drawings wherein:

FIGS. 15A and 15B are explanatory views to supplement the flow chart in FIG. 13.

DETAILED DESCRIPTION OF THE PREFERRED EMBODIMENTS

With reference to the accompanied drawings, a description will now be made about a tape processing apparatus, a method of processing a tape, and a program for performing the tape processing.

The label forming apparatus is made up of: a print-processing section which lies in the front part and performs printing of the written letters (written-letter printing); and an emboss-processing section which lies in the rear part and performs embossing of the raised letters (raised-letter embossing). After performing the written-letter printing in the print-processing section, a target tape that has been discharged therefrom is manually inserted by the user into the emboss-processing section to thereby perform raised-letter embossing in the emboss-processing section. On the target tape which is to be subjected to the raised-letter embossing, printing is made of upside-and-downside identifying information which is used to identify the upside (upper side) and downside (lower side) of the target tape as seen in the widthwise direction thereof, and manual-insertion indicating information which is used to indicate the direction of manual insertion of the target tape, together with the written-letter data based on the inputted character information.

Figure 1:
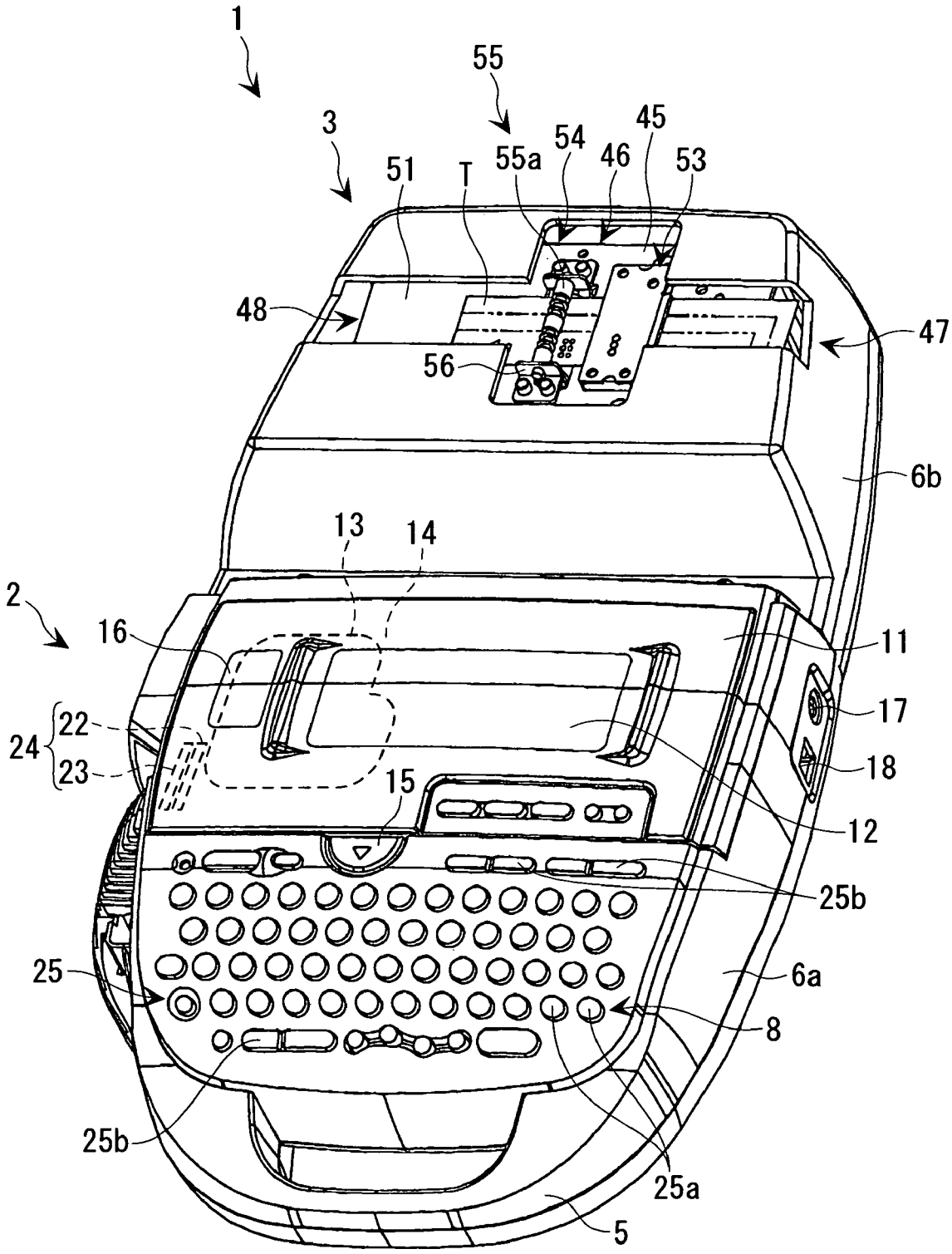
FIG. 1 is an external perspective view of a label forming apparatus in a state in which a lid is kept closed.
Figure 2:
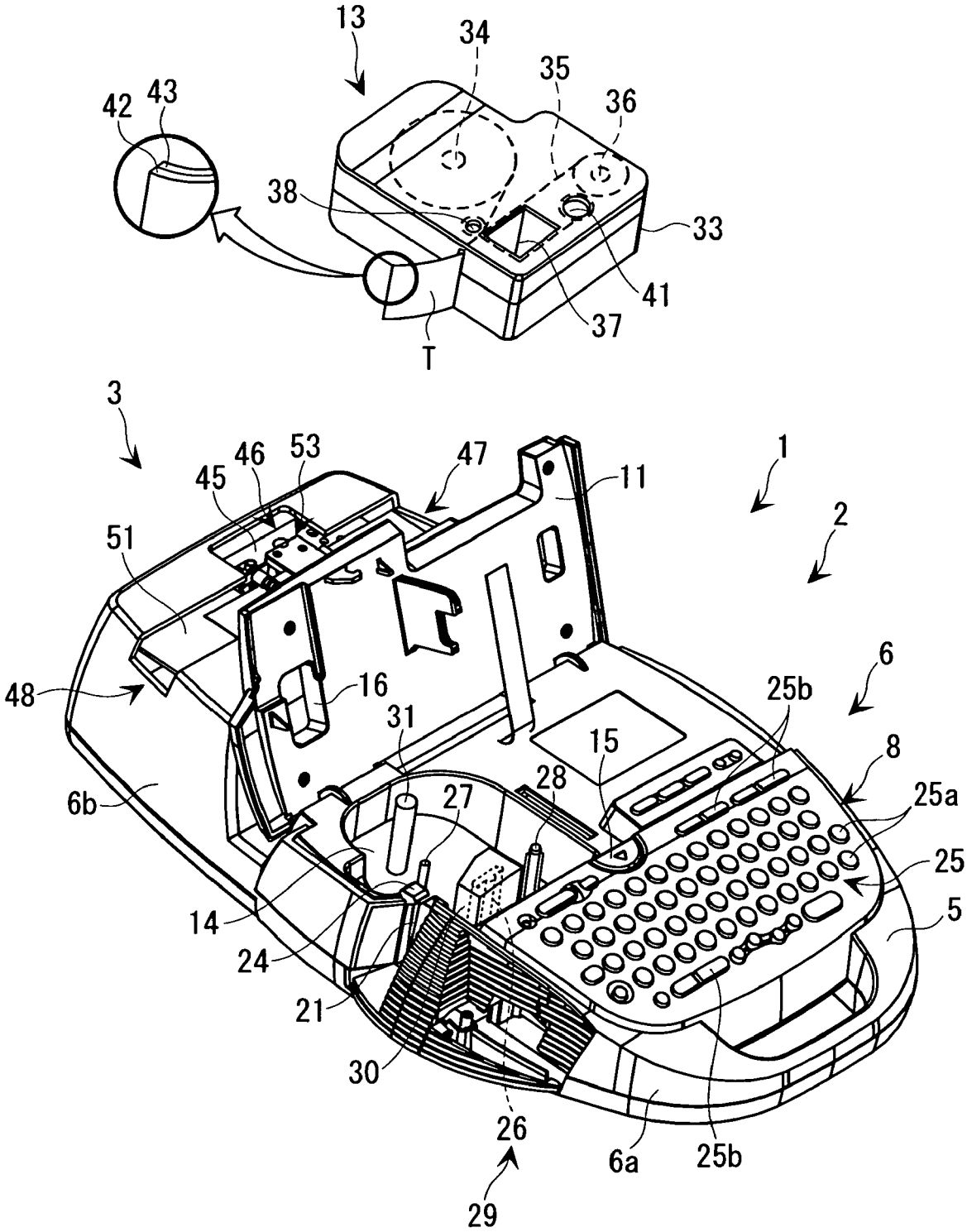
FIG. 2 is an external perspective view of the label forming apparatus in a state in which the lid is left open.

FIG. 1 is a perspective outside view of the label forming apparatus 1 in a state in which a lid is closed. FIG. 2 is a perspective outside view thereof in a state in which the lid is left open. As shown in the above figures, the label forming apparatus 1 has an apparatus casing 6, as an outer shell, which is divided into two, i.e., a front casing 6*a* having a carrying handle 5 at a front end portion, and a rear casing 6*b*. The front casing 6*a* has built therein a main apparatus of a print-processing section 2 so that the written-letter printing can be performed on a target tape T to be rolled or paid out of a tape cartridge 13 which is mounted on the main apparatus. The rear casing 6*b* has built therein a main apparatus of an emboss-processing section 3 so that raised-letter embossing can be performed on the target tape T that has been discharged out of the print-processing section 2 and is manually inserted into the raised-letter embossing section 3.

On a front upper surface of the front casing 6*a*, there is disposed a keyboard 8 which is provided with various input keys 25. On the rear upper surface thereof, there is mounted an open/close lid 11. On the surface of the open/close lid 11, there is disposed a display 12 in the central portion. On an inside of the open/close lid 11, there is formed in a recessed manner a cartridge mounting portion 14 for mounting a tape cartridge 13 which contains therein the target tape T. The tape cartridge 13 is detachably mounted on the cartridge mounting portion 14 in a state in which the open/close lid 11 is left open by the depression of a lid-body open button 15. A peep hole 16 is formed in the left part of the open/close lid 11 so that the presence or absence of the tape cartridge 13 can be confirmed with the open/close lid 11 closed.

The front casing 6*a* is provided on the right side thereof with an electric power supply port 17 for supplying electric power and a connection port 18 (interface) for connection to an outside apparatus such as a personal computer, or the like (not illustrated). It is thus so arranged that, by connecting the outside apparatus to the connection port 18, the written-letter printing and raised-letter embossing can be performed based on the character information generated by the outside apparatus.

A printed-tape discharge port 21 which is in communication with the cartridge mounting portion 14 and the outside of the apparatus is formed on the left side of the front casing 6*a*. This printed-tape discharge port 21 has a cutting section 24 in a manner to face it. The cutting section 24 is provided with: a full cutter 22 (full-cut means or full-cutting means) which is driven by a motor (full-cut motor 19, see FIG. 6) and is of a slide type to full-cut the target tape T; and a half cutter 23 (half-cut means or half-cutting means) which is similarly driven by a motor (half-cut motor 20, see FIG. 6) and is of a slide type to half-cut the target tape T. When the target tape T is fed out of the printed-tape discharge port 21, the target tape T is subjected to the full cutting and the half cutting by means of the cutting section 24.

Although not shown in detail, the full cutter 22 has a cutter blade which is capable of slide-cutting in the upside-and-downside direction. The cutter blade (cutter holder) is arranged to be movable in a sliding manner in the widthwise direction of the target tape T through a crank mechanism. When the cutter blade moves in a sliding manner, both a recording tape 42 and a release tape 43 of the target tape T facing thereto are cut, i.e., the target tape T is full-cut.

Similarly, the half cutter has an inclined cutter blade which is constituted substantially into the same shape as the full cutter and is capable of slide-cutting. It is thus so arranged that the half cutter 23 is capable of operating in a sliding manner through a crank mechanism. When the cutter blade moves in a sliding manner, only the recording tape 42 of the target tape T facing the cutter blade is cut, i.e., the target tape T can be half-cut. In this case, the amount of projection of the cutting blade is adjusted to be, unlike the one of the full cutter 22, such that only the recording tape 42 is cut. As a result of this half cutting, there is formed a waste margin Ta (to be described in detail hereinafter) on the front side, as seen in the direction of manual insertion, of the target tape T.

The keyboard 8 is used to input various operation commands and data into a control section 75 (to be described in detail hereinafter). The keyboard 8 has disposed therein various input keys, i.e., character key group 25*a*, and function key group 25*b* for designating various operation modes, or the like. The character key group 25*a* is used to input character information for performing written-letter printing and/or raised-letter embossing, and has a full-key arrangement according to Japanese Industrial Standard (JIS). The function key group 25*b* includes: an execution key for causing the written-letter printing and/or raised-key embossing to be executed or performed; a start key for commanding to start the feeding of the target tape T in the emboss-processing section 3; an emboss-start key for causing the raised-letter embossing to be started manually; and a mode selection key for selecting the processing mode for performing the written-letter printing and/or raised-letter embossing. Aside from the above keys, the function key group 25*b* includes, like in the ordinary word processor: a delete key for deleting a processing, or the like; a cursor key for moving a cursor; an enter key for determining options on various option screen, for line feeding at the time of text inputting, or the like.

As the processing modes to be selected by the mode selection key, there can be listed: a first processing mode (see FIG. 8A) for performing the written-letter printing and the raised-letter embossing based on the inputted character information; a second processing mode (see FIG. 8B) for performing only the written-letter printing based on the inputted character information; a third processing mode (see FIG. 8C) for performing only the raised-letter embossing based on the inputted character information. One processing mode is selected out of these three. A description will now be made mainly about a case in which the first processing mode is set.

The display 13 is capable of displaying display image data of 192 dots×80 dots inside a rectangle of about 12 cm long (X direction)×about 5 cm wide (Y direction). It is used by the user in inputting character information to thereby prepare and edit the written-letter data for performing printing operation, and the raised-letter data for performing embossing operation. Various errors or messages (contents of commands) are displayed for reporting to the user.

The cartridge mounting portion 14 is provided with: a head unit 29 which has housed in the head cover 30 a printing head 26 (printing means) made up of a thermal head; a platen driving shaft 27 which lies opposite to the printing head 26; a take-up driving shaft 28 for taking up an ink ribbon 35 (to be described hereinafter); and a positioning projection 31 for positioning a tape reel 34 (to be described hereinafter). In the space below the cartridge mounting portion 14, there are housed a print-feed motor 32 (see FIG. 6) and a power transmitting mechanism (not illustrated) for rotating the take-up driving shaft 28.

As shown in FIG. 2, the tape cartridge 13 houses inside the cartridge casing 33 a tape reel 34 around which is wound the target tape T of a certain width, and a ribbon reel 36, on the right side, around which is wound an ink ribbon 35. The target tape T and the ink ribbon 35 are formed into the same width. On the left side of the tape reel 34, there is formed a through opening for inserting the tape reel 34 into the head cover 30 which covers the head unit 29. A platen roller 38 which rotates to drive the platen driving shaft 27 is disposed so as to correspond to the portion where the target tape T and the ink ribbon 35 are overlapped with each other. A ribbon take-up reel 41 is disposed close to the ribbon reel 36. The ink ribbon 35 paid out of the ribbon reel 36 is taken up by the ribbon take-up reel 41 which is disposed in a manner to turn round the head cover 30. The target tape T is held in the tape cartridge in a state in which the front end thereof slightly protrudes forward.

When the tape cartridge 13 is mounted in the cartridge mounting portion 14, the head cover 30 is inserted into the head cover 30, the positioning projection 37 is inserted into the central hole of the tape reel 34, the take-up drive shaft 28 is inserted into the central hole of the ribbon take-up reel 41, and the platen drive shaft 27 is inserted into the platen roller 38, respectively. As a result, the printing head 26 comes into contact with the platen roller 38 with the target tape T and the ink ribbon 35 sandwiched therebetween, so that the written-letter printing becomes possible. In the written-letter printing, aside from the written-letter printing based on the inputted character information, there are performed the printing of: upside-and-downside identifying information D to identify the upside and the downside of the target tape T (see FIG. 5); and indicating information E to indicate the direction of manual insertion of the target tape T (to be described in detail hereinafter). After having performed the printing of the written-letter data based on the inputted character information, the processed target tape T is discharged out of the apparatus through the printed-tape discharge port 21.

The target tape T is made up of: the recording tape 42 which has an adhesive-agent layer on the rear surface thereof and is constituted by a polyethylene terephthalate (PET) film; and the release tape 43 which is adhered by this adhesive-agent layer to the recording tape 42 (see FIG. 2). The release tape 43 is to prevent the adhesive-agent layer from getting stained with dirt, or the like, until recording tape 42 is put to actual use and is constituted by a high-quality paper (made of PET in the embodiment) having coated on the surface thereof with silicone.

As the target tape T, there are prepared a plurality of kinds, e.g., those having three different tape widths of 12 mm, 18 mm and 24 mm as well as those having different kinds of tapes (tape color, written-letter ink color, tape material, or the like). A plurality of holes (portions to be detected; not illustrated) are formed on the rear surface in order to detect the above-described kinds. In addition, the cartridge mounting portion 14 is provided with a plurality of tape recognition sensors 44 (micro switches) for the detection thereof (see FIG. 6). By the cooperation of the tape recognition sensors 44 and the above-described detected portion, the tape can be identified.

On the other hand, the rear casing 6*b* forms the main body of the emboss-processing section 3 and has contained therein a raised-letter embossing assembly 46 which has assembled the main constituting member in an apparatus frame 45. The upper surface of the rear casing 6*b* is opened into the shape of a cross so that the upper part of the raised-letter embossing assembly 46 can be exposed. On the right side of this exposed portion, there is formed an inserting portion 47 into which the tape to be embossed (also referred to as "an embossing tape inserting portion) is manually inserted. On the left side thereof, there is formed an embossed-tape discharging portion 48 for discharging the embossed target tape T. In other words, the embossing tape inserting portion 47 whose upper surface is left open is formed on the right side of the exposed cross shape, and the embossed-tape discharging portion 48 for discharging the raised-letter embossed target tape T is formed on the left side. As a result, a tape traveling passage 51 is formed so as to cross the raised-letter embossing assembly 46.

The raised-letter embossing assembly 46 is made up of: an embossing unit 53 (embossing means) which performs embossing by three embossing pins 52 (see FIG. 3B); a tape feeding mechanism 54 which feeds the target tape T inserted into the embossing tape inserting portion 47 toward the embossed-tape discharging portion 48; and a tape traveling passage 51 which extends from the embossing tape inserting portion 47 to the embossed-tape discharging portion 48. It is so arranged that three embossing pins 52 of the embossing unit 53 are selectively driven to thereby form embossed letters on the target tape T which is fed by the diving of the tape feeding mechanism 54 along the tape traveling passage 51.

The tape feeding mechanism 54 is made up of: a feed roller 55 which feeds the target tape T by the rotation thereof; a supporting member 56 which rotatably supports the feed roller 55 to the apparatus frame 45; and an emboss-feed motor 57 (see FIG. 6) which rotates the feed roller 55 through a power transmission mechanism (not illustrated). The feed roller 55 is constituted by a grip roller which is made up of a driving roller (not illustrated) and a driven roller 55*a*. In order to prevent the formed raised letters 65 from being damaged, three annular grooves 58 are formed (see FIG. 5) at three points on the upper side and on the lower side, respectively, as seen in the widthwise direction of the tape traveling passage 51 (i.e., at points corresponding to the three embossing points; see FIG. 4A).

Figure 3A:
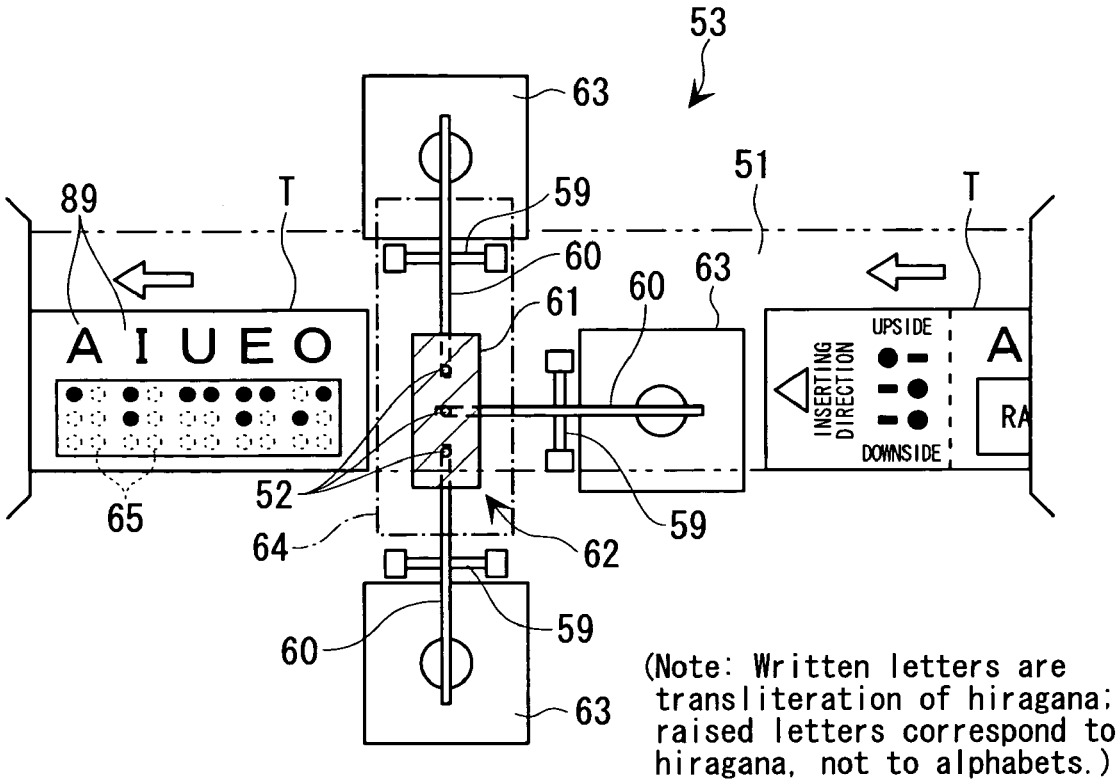
FIG. 3A is a plan view of an embossing means and FIG. 3B is a side view, partially shown in section, thereof.
Figure 3B:
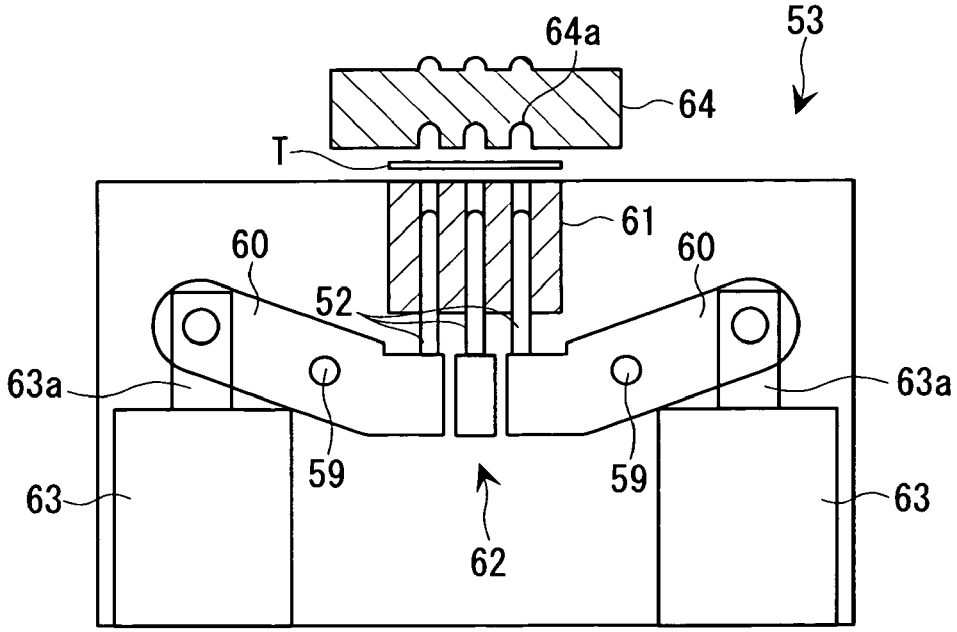

As shown in FIGS. 3A and 3B, the embossing unit 53 is made up of: an embossing head 62 which is disposed on the rear side of the introduced target tape T and has assembled the above-described three embossing pins 52 into a guide block 61; three solenoids 63 which operate to emboss the respective embossing pins 52 through embossing arms 60; and emboss-receiving member 64 which is disposed in a position opposite to the embossing head 62 (embossing pins 52) with the target tape T interposed therebetween (see FIG. 3B). It is to be noted that, in this example, the written letters on the upper side as seen in FIG. 3A are transliteration of Japanese hiragana ("A," "I," and "U") into corresponding alphabets of "AIU", but that the raised letters on the lower side correspond to those of the hiragana, not to the alphabets. This is partly to avoid the use of language other than alphabets where possible. The same applies to other similar examples in, e.g., FIGS. 15A and 15B.

The three embossing pins 52 are disposed at a distance of 2.4 mm and correspond to the three vertically arrayed embossing points out of the six embossing points. Each of the embossing pins 52 is held in a perpendicular posture relative to the target tape T. At the rear portion of each embossing pin 52, there is connected one end of the embossing arm 60 in a semi-permanently fixed manner. The other end of this embossing arm 60 has connected thereto a front end portion of a plunger 63*a* of the solenoid 63 (to be described in detail hereinafter) in a hinged manner. A supporting shaft 59 is provided such that the intermediate portion of the embossing arm 60 is supported in a rotatable manner. Therefore, when the plunger 63*a* performs a linear movement by the plunger 63, the embossing arm 60 rotates about the supporting shaft 59, whereby the embossing pin 52 performs a linear movement (embossing movement) in the perpendicular direction relative to the target tape T.

Figure 5:
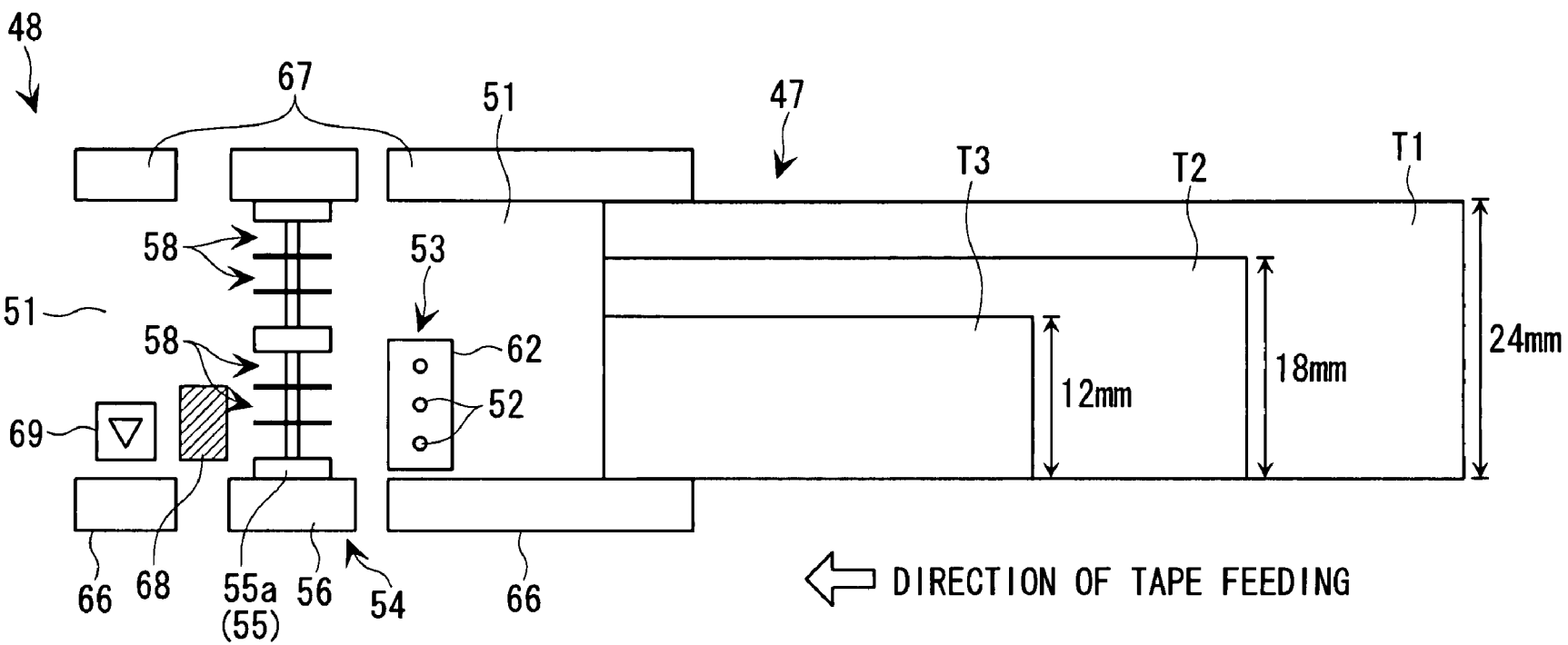
FIG. 5 is a schematic plan view explaining the feeding of a target tape T in an emboss-processing section.

The emboss-receiving member 64 is provided with three receiving grooves 64*a* which correspond to the three embossing pins 52. By causing the embossing pins 52 to perform embossing operation toward the receiving grooves 64*a* as a result of driving the solenoids 63, the embossed projections 65*a* are formed on the target tape T. The embossing unit 53 is fixedly disposed toward one side (lower side) as seen in FIGS. 3A and 5 of the tape traveling passage 51 (i.e., as seen in the widthwise direction of the target tape T). It follows that the embossing on the target tape T having a maximum width of 24 mm is performed on the lower half as seen in FIG. 5.

Figure 4A:
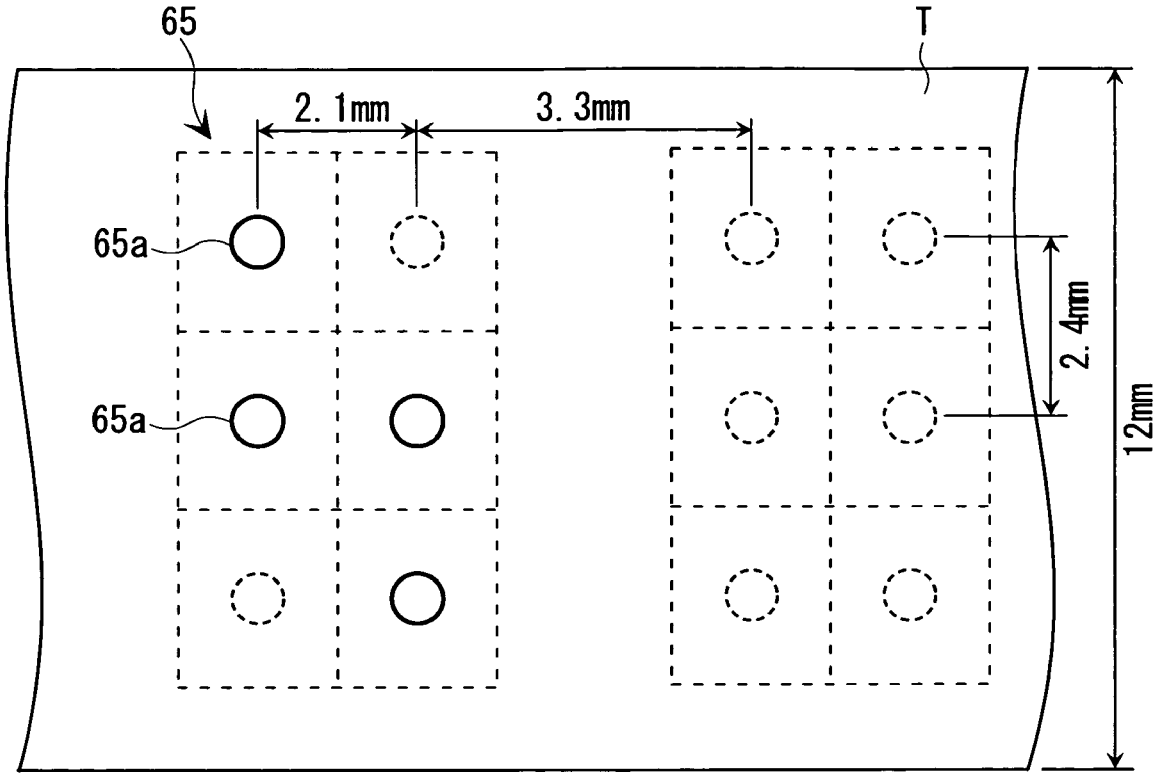
FIG. 4A is a schematic plan view explaining a six-point raised letter and 4B is a sectional view thereof.
Figure 4B:
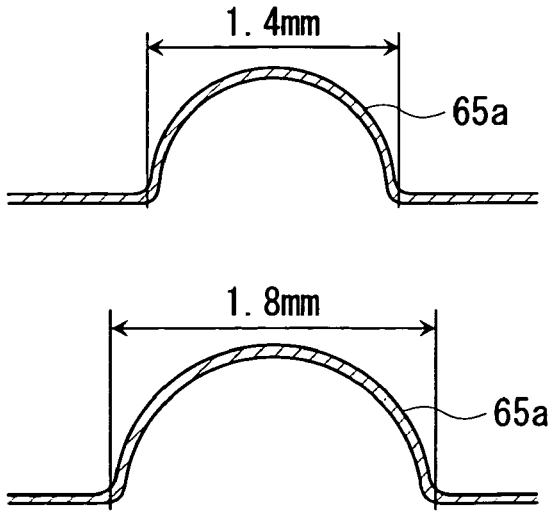

With reference to FIGS. 4A and 4B, a description will now be made about the raised letters (Braille) 65 (six-point raised letters) to be formed on the target tape T. FIG. 4A shows a raised letter corresponding to Japanese hiragana "SHI" by using four embossing points out of six embossing points, and also shows the positional relationship with the adjacent raised letter 65. The six-point raised letter 65 is made up of one frame having six points of three vertically arrayed points in two horizontally separated rows. One frame represents one character as well as other properties such as a voiced sound, or the like. In other words, six-point character 65 is divided into six embossing points of three vertical points (stages) in two horizontally separated rows. In the illustrated example of "SHI," four embossing points out of six are selectively embossed to thereby form four embossed (or raised) projections 65*a* on the target tape T. Each of the embossed projections 65*a* has a vertical pitch of about 2.4 mm, a horizontal pitch of about 2.1 mm, and a pitch of about 3.3 mm to the adjacent frame (pitch between frames).

As the raised letters 65, aside from the six-point raised letters to represent hiragana/katakana letters, numerals, or the like, eight-point raised letters are also used to represent Chinese characters with eight-point bit patterns made up of four vertical points (stages) in two horizontally separated rows. The label forming apparatus 1 of this embodiment is to emboss six-point raised letters 65. It may, however, be arranged to enable embossing of eight-point raised letters.

FIG. 4B shows a cross section of an embossed projection 65*a*. As shown therein, the shape of the embossed projection 65*a* is semicircular in cross section. The shape of the embossed projection 65*a* may be cylindrical with the corners rounded so as to become soft to the sense of touching. It may, of course, be of other shapes such as conical, quadrangular pyramid, or the like.

As the embossing unit 53, an arrangement may be made such that a unit for forming small embossed projections 65*a* and a unit for forming large embossed projections 65*a* can be alternately replaceable. The small embossed projections 65*a* have a cylinder diameter of about 1.4 mm and a height of about 0.4 mm. The large embossed projections 65*a* have a cylinder diameter of about 1.8 mm and a height of about 0.5 mm. These two units for the small and large embossed projections 65*a* are separately employed depending on the uses to which they are put. For example, the unit for small embossed projections is for those who are born blind and are accustomed to reading the raised letters B and the unit for large embossed projections is for those who have lost their eyesight on the way of their life.

With reference to FIG. 5, a description will now be made about the feeding of the target tape T in the emboss-processing section 3. The emboss-processing section 3 is provided with: the embossing unit 53 which forms embossed projections 65*a* on the target tape T by means of the embossing pins 52; the tape traveling passage along which the target tape T is transferred; and the tape feeding mechanism 54 which transfers target tape T along the tape traveling passage 51. The emboss-processing section 3 is further provided with: guide members 66, 67 which guide the transfer of the target tape T; a transmission type of front-end detection sensor (front-end detecting means) 68 which detects the front end of the target tape T; and a refection type of upside-and-downside identifying sensor 69 (information detection means) which detects the upside-and-downside identifying information for identifying the upside and the downside of the target tape T.

The embossing tape inserting portion 47 is arranged to be capable of accepting the insertion of a target tape T1 (tape width 24 mm), a target tape T2 (tape width 18 mm), and a target tape T3 (tape width 12 mm), as counted from the ones with larger tape width. The target tape T1 with the largest tape width is guided by the lower and upper guide members 66, 67, and the target tapes T2, T3 of other tape widths are guided by the lower guide member 66 only. For example, when the target tape T3 of the smallest tape width is used, the user manually inserts the target tape T3 along the lower guide member 66 until the front end thereof reaches the tape feeding mechanism 54 (feed roller 55; i.e., up to the limit to which the tape can be fed). Then, by depressing the tape-feed start key on the keyboard 8, the feeding of the target tape T3 by the tape feeding mechanism 54 can be started.

Right after the starting of feeding of the target tape T3, the front end of the target tape T3 is detected by the front-end detection sensor 68 and, after feeding it to an appropriate position, the embossing is started. In case the length of the front waste margin between the front end of the target tape T and the emboss-start position is set to be smaller or shorter than the length L1 (see FIG. 10A) between the embossing unit 53 (embossing pins 52) and the front-end detection sensor 68, the feed roller 55 is rotated in the reverse direction of rotation to thereby return the target tape T and then feed it to an appropriate position to thereby start embossing and tape feeding in the ordinary direction of rotation. It is to be noted that the above operations are based on the presumption, from the viewpoint of the position of the feed roller 55, that the front waste margin is set to be larger or longer than the length L2 between the embossing unit 53 and the feed roller 55. The emboss-processing based on the result of detection by the upside-and-downside identifying sensor 69 will be described in detail hereinafter.

The embossing by the embossing unit 53 may be arranged, instead of triggering the detection of the tape front end by the front-end detection sensor 68, such that the user manually starts it by depressing the emboss-start key on the keyboard 8.

Figure 6:
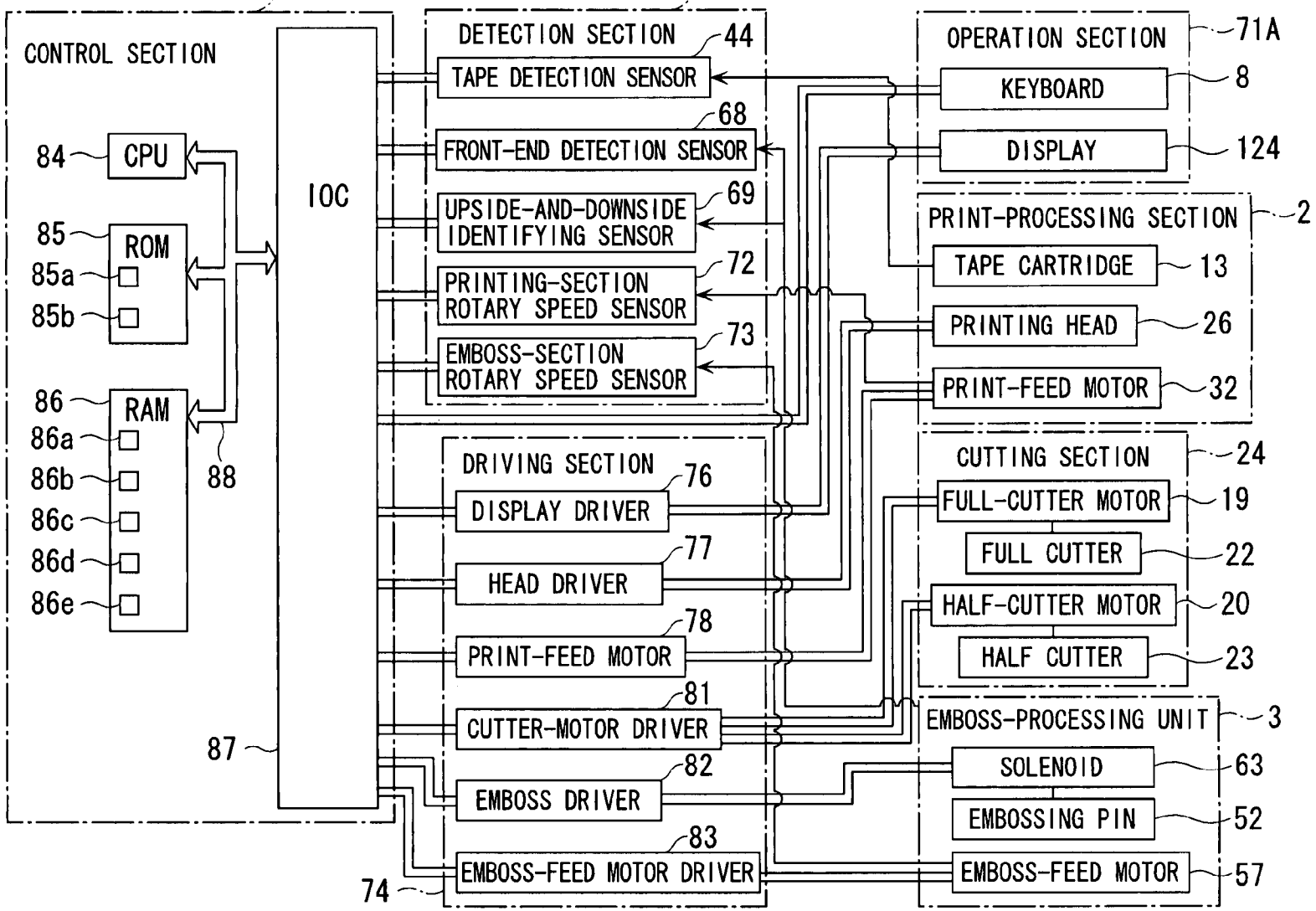
FIG. 6 is a control block diagram of the label forming apparatus.

With reference to FIG. 6, a description will now be made about the control system of the label forming apparatus 1. The label forming apparatus 1 is made up of: an operation section 71A which serves as the user interface; a print-processing section 2 which performs written-letter printing; an emboss-processing section 3 which performs embossing of the raised letters; a cutting section 24 which cuts the target tape T to a predetermined length; a detecting section 71B which performs various detections; a driving section 74 which drives various members; and a control section 75 which is connected to the various members and controls the entire label forming apparatus 1.

The operation section 71A has the keyboard 8 and the display 12 and performs inputting of character information by the user and displaying of various information. The print-processing section 2 has the tape cartridge 13, the printing head 26 and the print-feed motor 32, and prints the written-letter data on the target tape T based on the character information while feeding the target tape T and the ink ribbon 35. The cutting section 24 has: the full cutter 22 and the full-cut motor 19 for driving it; and the half cutter 23 and the half-cut motor 20 for driving it. The cutting section 24 thus forms the cutting line for half cutting on the print-processed target tape T and also cuts off the printed portion (full cutting).

The detecting section 71B is made up of: the above-described tape recognition sensor 44 for detecting the kind of the target tape T (tape cartridge 13); the above-described front-end detection sensor 68 for detecting the front end of the target tape T in the emboss-processing section 3; the upside-and-downside identifying sensor 69 for detecting the upside-and-downside identifying information D which is printed on the target tape T in the emboss-processing section 3; a printing-section rotary speed sensor 72 for detecting the rotary speed of the print-feed motor 32; and an emboss-section rotary speed sensor 73 for detecting the rotary speed of the emboss-feed motor 57, whereby various detections are performed in this detecting section 71B.

The driving section 74 is made up of: a display driver 76; a head driver 77; a print-feed motor 78; a cutter-motor driver 81; an embossing driver 82 for driving the solenoids 63 and the embossing pins 52 in the emboss-processing section 3; and a emboss-feed motor driver 83 for driving the emboss-feed motor 57 in the emboss-processing section 3, whereby driving of the above-described various actuators is performed in this driving section 74.

The control section 75 is made up of: a CPU 84; a ROM 85; a RAM 86; and an input output controller (IOC) 87, which are connected together by an internal bus 88. The ROM 85 is made up of: a control program block 85*a* which stores therein a control program for controlling various processing such as written-letter print-processing, raised-letter emboss-processing, or the like, with the CPU 84; and a control data block 85*b* which stores therein control data, raised-letter font data for performing raised letter embossing, control data for performing emboss control of raised-letter data, or the like. The character font data may be stored in a separate CG-ROM, instead of storing it in the ROM 85.

Figure 10A:
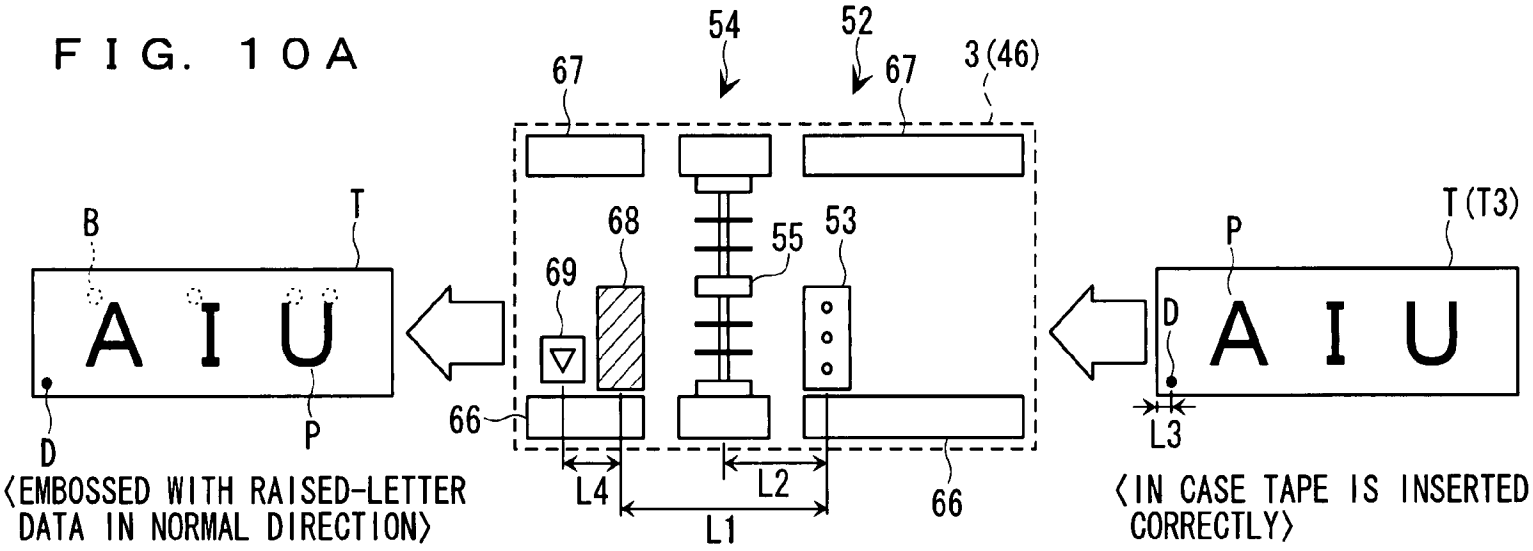
FIGS. 10A and 10B are explanatory views to supplement the flow chart in FIG. 9.
Figure 10B:
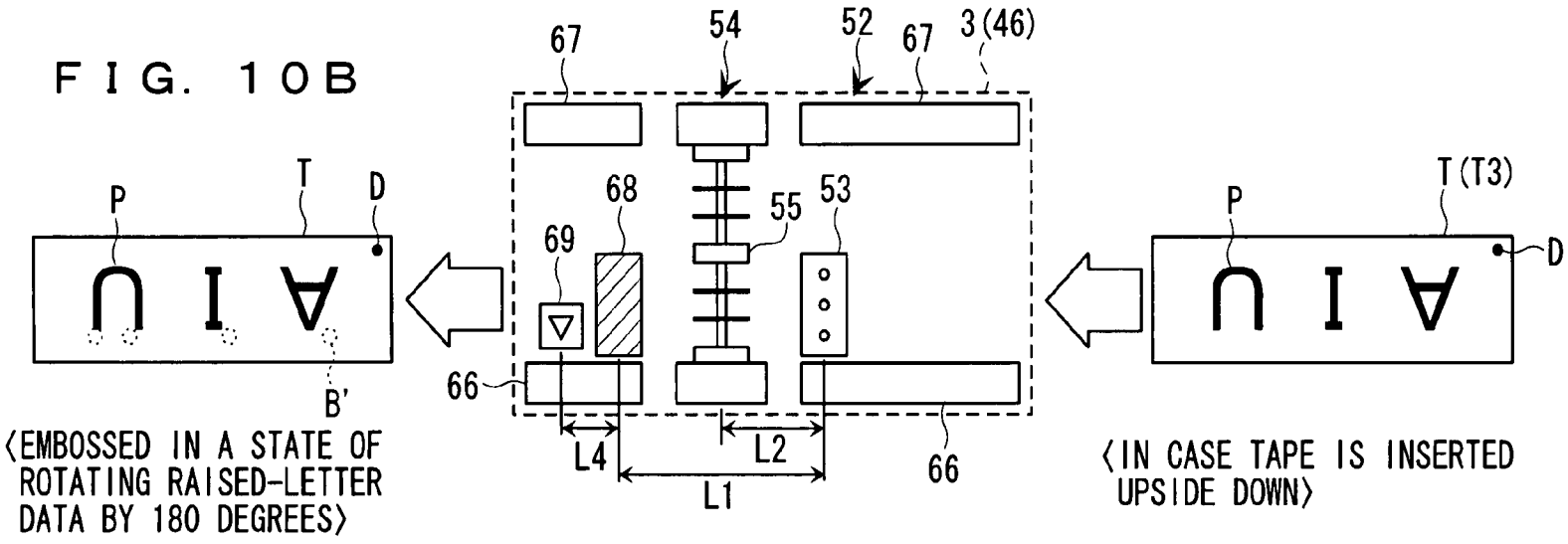

The RAM 86 is made up of: various work area block 86*a* which is used as a flag, or the like; a written-letter print data block 86*b* which stores therein the generated written-letter print data (including display image data); raised-letter emboss-data block 86*c* which stores therein the generated emboss data; a display data block 86*d* which stores therein the display data for displaying on the display 12; and an inverted raised-letter data block 86*e* which stores therein the inverted-raised-letter data B' for use in embossing the raised-letter data in a state of turning or rotating by 180 degrees (data in which the raised-letter data is developed from the rear end, see FIG. 10B). These blocks are used as working areas for control processing. The RAM 86 is constantly backed up to keep the stored data in preparation for a power failure.

The IOC 87 has assembled therein a logic circuit which supplements the function of the CPU 84 and also handles the interface signals with various peripheral circuits, in the form of a gate array, LSIs, or the like. According to this arrangement, the IOC 87 captures the inputted data and control data from the keyboard 8 as they are or with due processing and, in interlocking with the CPU 84, outputs the data and control signals outputted from the CPU 84 to the internal bus 84 as they are or with due processing.

According to the above arrangement, the CPU 84 inputs various signals and data from each section of the label forming apparatus 1 through the IOC 87 in accordance with the control program in the ROM 85. In addition, by processing the various data inside the RAM 86 based on the various inputted signals and data to thereby output various signals and data to each section inside the label forming apparatus 1 through the IOC 87, whereby the written-letter print-processing and/or raised-letter emboss-processing can be performed.

The emboss-processing section 3 is made up of: the solenoid 63; the embossing pins 52; and the emboss-feed motor 57. The raised-letter is embossed on the target tape T based on the generated raised-letter emboss data while feeding the target tape T.

When the character information is inputted by the user through the keyboard 8, the CPU 84 generates written-letter data based on the inputted character information together with a manually inserted display image and temporarily stores them inside the written-letter data block 86*b*. When a command of printing/embossing and raised-letter embossing character array is received through the keyboard 8, the CPU 84 generates raised-letter embossing data and temporarily stores it inside the raised-letter emboss-data block 86*c* and also starts the driving of the print-feed motor 32 and drives the printing head 26. Written-letter printing is thus performed based on the written-letter data inside the written-letter print data block 86*b*. At this time, together with the written-letter data, the printing of the upside-and-downside identifying information D is also performed based on the data which is stored in advance inside the control data block 222. Thereafter, while performing the feeding of the tape based on the written-letter print data, inclusive of the rear waste margin data if the length of the rear waste margin can be set at the time of inputting the character information, half-cutting is performed with the half cutter 23, and the rear end of the target tape T is cut off with the full cutter 23. The print-processed tape T is thus discharged out of the printed-tape discharge port 21.

When the target tape T is inserted into the embossing tape inserting portion 47 by the user, the CPU 84 performs embossing of the raised letters in the emboss-processing section 3 by driving the embossing unit 53 and the tape-feed mechanism 54 based on the generated raised-letter embossing data. When the embossing of the raised letters has been finished, the emboss-feed motor 57 is driven to thereby feed the tape, so that the embossed tape T is discharged out of the embossed-tape discharging portion 48.

A description will now be made about two embodiments in printing and embossing (label forming method) using the label forming apparatus 1 according to this invention. In the first embodiment, the upside-and-downside identifying information D to identify or recognize the upside and the downside of the target tape T is printed on the target tape T, and this upside-and-downside identifying information D is detected to control the raised-letter embossing. In the second embodiment, the direction of embossing the raised letters is taken into consideration in advance to thereby print the manual-insertion indicating information E which indicates the direction of manually inserting the target tape T. Although the details are given hereinafter, the second embodiment does not always require the above-described upside-and-downside identifying sensor 68.

Figure 7:
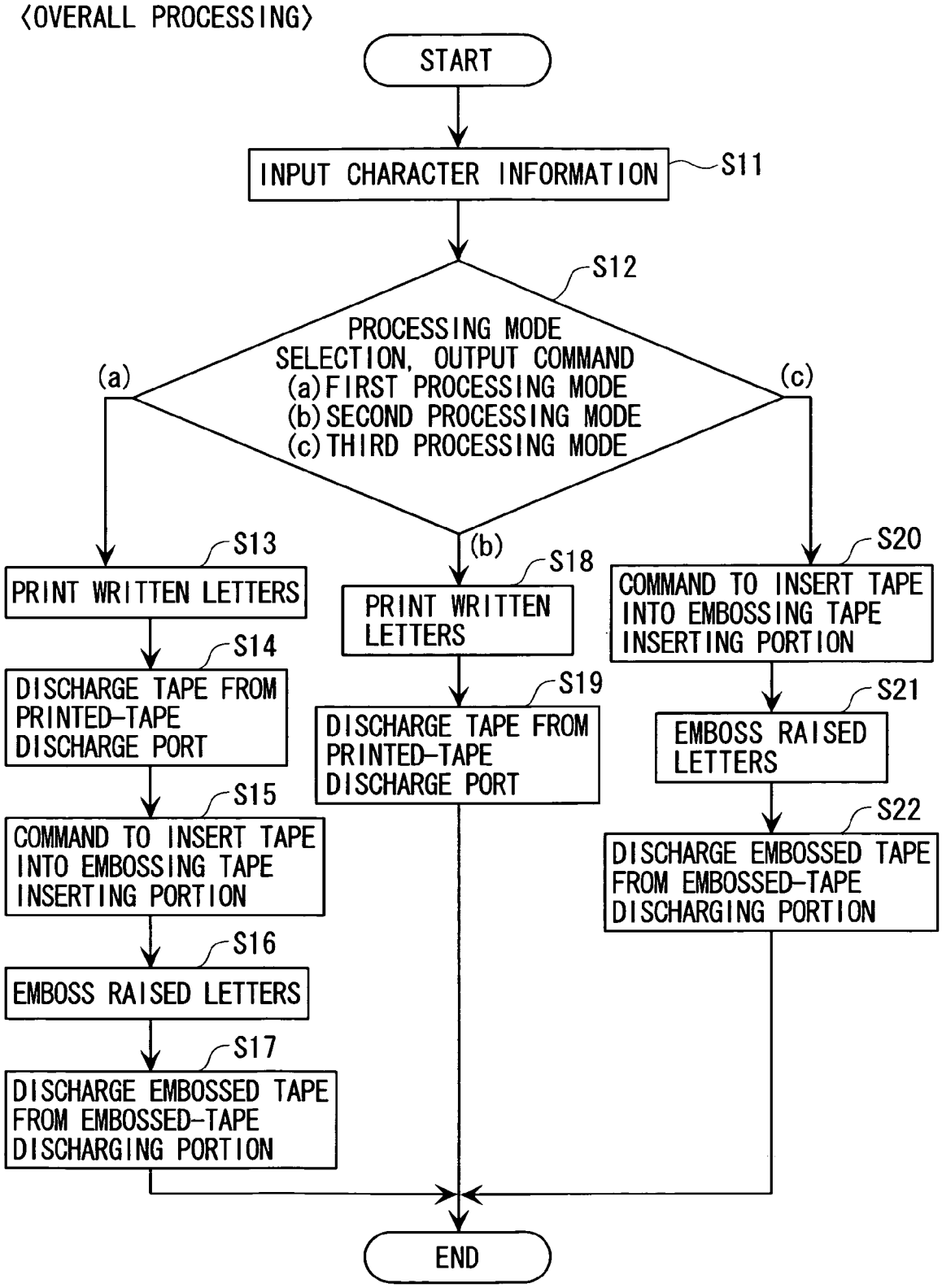
FIG. 7 is a flow chart showing an entire processing of the label forming apparatus according to first embodiment of this invention.

With reference to FIGS. 7 and 8, a description will now be made about the entire processing in the print processing and emboss processing in the first embodiment. As shown in FIG. 7, when the character information is inputted by the user through data input from an outside apparatus such as the keyboard 8, a personal computer, or the like (S11), the processing mode selection is made so that an output command is given of the written-letter printing and/or the raised-letter embossing (S12). The selection of the processing mode and the command outputting are made by depressing the execution key after inputting the character information or by depressing the processing mode selection key.

Figure 8A:
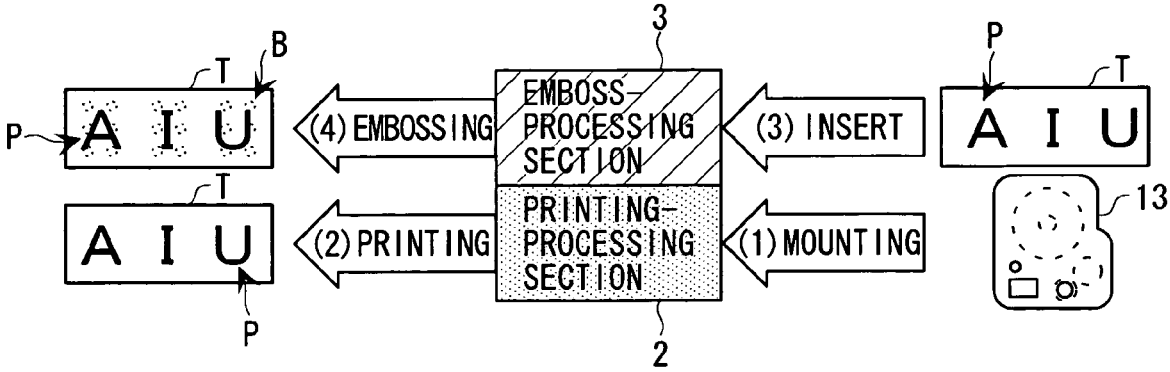
FIGS. 8A through 8C are explanatory views to supplement the flow chart in FIG. 7.

If the first processing mode is selected (S12:(*a*)), the written-letter printing is performed by the print-processing section 2 (S13), and then the target tape T is discharged out of the printed-tape discharge port 21 (S14). A command is then given on the display 12 to insert the tape into the embossing tape inserting portion 47 (S15). This display may also be made by an indicator or an LED. When the user inserts the target tape T into the embossing tape inserting portion 47 according to the instruction to insert the tape, embossing of the raised letters is performed by the emboss-processing section 3 (S16). After embossing, the embossed target tape T is discharged out of the embossed-tape discharging portion 48 (S17), whereby the processing is finished. In other words, in the first processing mode, the processing as shown in FIG. 8A is performed. Namely, the target tape T paid out of the mounted tape cartridge 13 is sent to the print-processing section 2 for printing therein the written letters P. Then, the target tape T having printed thereon the written letters and having cut off is manually inserted into the emboss-processing section 3, to thereby emboss the raised letters B.

Figure 8B:
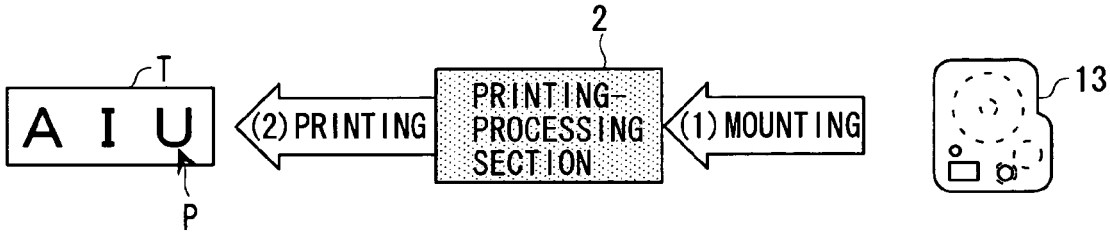

If the second processing mode is selected (S12:(*b*)), the written-letter printing is performed by the print-processing section 2 (S18), and then the target tape T is discharged out of the printed-tape discharge port 21 (S19), thereby finishing the processing. In other words, in the second processing mode, the processing as shown in FIG. 8B is performed. Namely, the target tape T paid out of the mounted tape cartridge 13 is sent to the print-processing section 2 for printing therein the written letters P. When the second processing mode has been selected, the printing of the upside-and-downside identifying information D or the manual-insertion indicating information E may be omitted.

Figure 8C:
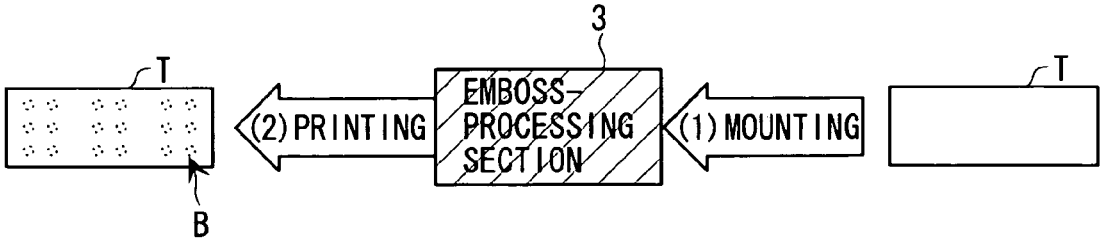

If the third processing mode is selected (S12:(*c*)), a command is given on the display 12 to insert the tape into the embossing tape inserting portion 47 (S20). When the user has inserted the tape and finished embossing of the raised letters (S21), the embossed target tape T is discharged out of the embossed-tape discharging portion 48 (S22), whereby the processing is finished. In other words, in the third processing mode, the processing as shown in FIG. 8C is performed. Namely, the target tape T that has been cut into a rectangle of a predetermined length is manually inserted into the emboss-processing section 3, to thereby emboss the raised letters B.

In the above description, an arrangement has been made such that the processing mode shall be selected out of the three options. It is, however, possible to add the following mode. Namely, the target tape T which is prepared in advance is arranged to be insertable into the print-processing section 2. After having finished the raised-letter embossing, the written-letter printing is performed. Alternatively, the following arrangement is also possible. Namely, the tape cartridge 13 is arranged to be mounted on an upstream side of the emboss-processing section 3 so that the raised-letter embossing is performed on an elongated tape paid out of the tape cartridge 13. In addition, the written-letter printing and the raised-letter embossing may be arranged to be performed based not on the same character information but on different character information.

Figure 9:
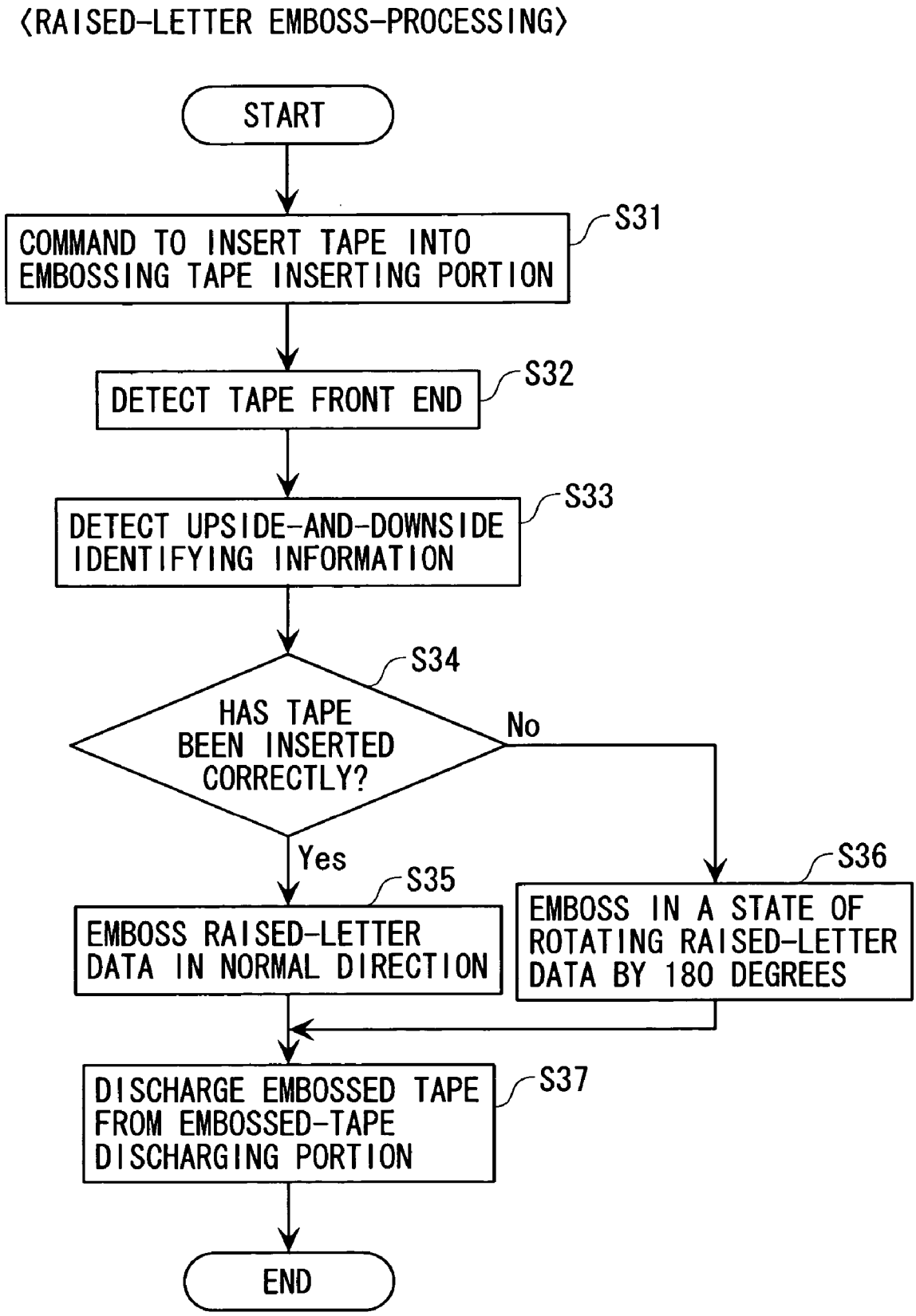
FIG. 9 is a flow chart showing the emboss-processing of the raised letters by the label forming apparatus according to a first embodiment of this invention.

Next, with reference to FIGS. 9 and 10, a description will now be made about the emboss-processing of the raised letters according to the first embodiment. As shown in FIG. 9, a command is given to insert the tape into the embossing tape inserting portion 47 (S31, corresponding to S15 and S20 in FIG. 7). When the target tape T that has printed thereon the written letters is inserted by the user, the front end of the target tape T is detected by the front-end detection sensor 68 (see FIG. 10) (S32). With the front-end detection serving as a reference, the rotation speed of the feed roller 55 is detected by the emboss-section rotation-speed sensor 73 (see FIG. 6). The tape feeding length is judged based on the detected rotation speed.

When the front end of the target tape T has been detected (S32), the upside-and-downside identifying information D is then detected by the upside-and-downside identifying sensor 69 (S33). The detection of the upside-and-downside identifying information D is made while the tape having a predetermined length capable of detecting the upside-and-downside identifying information D is fed in the positive direction. The predetermined length means here the length obtained by adding: a length L3 in the tape feeding direction from the tape front end to the upside-and-downside identifying information D (see FIG. 10A); a length L4 between the front-end detection sensor 68 and the upside-and-downside identifying sensor 69 (see FIG. 10A); and a given length taking into consideration a detection error. In other word, in case the upside-and-downside identifying information D is detected during the feeding of the predetermined length of the tape, a judgment is made that the target tape T has been correctly inserted as to the upside-and-downside relationship. On the other hand, if the upside-and-downside identifying information D is not detected even after feeding the tape by a predetermined length, a judgment is made that the tape has been inserted upside down (S34). The rotation of the feed roller 61 in the reverse direction is performed after detection of this upside-and-downside identifying information D in case the front-end waste margin between the tape front end and the emboss-start position is set to be shorter than the length L1 between the embossing unit 53 (embossing pins 52) and the front-end detection sensor 68.

Then, based on the result of detection by the emboss-section rotation speed sensor 73 and on the generated raised-letter data (inclusive of the data of the front-end waste margin from the tape front end to the emboss-start position), the emboss-start position (timing) is determined, and the raised-letter embossing is started from that position. In this case, if a judgment is made that the target tape T is correctly inserted as to the upside-and-downside relationship based on the result of detection of the upside-and-downside identifying information D by the upside-and-downside identifying sensor 69 (S34: yes), the raised-letter data is embossed in the normal direction (normal embossing) (S35). On the other hand, if a judgment is made that the target tape T is inserted upside down based on the result of detection of the upside-and-downside identifying information D by the upside-and-downside identifying sensor 69 (S34: No), the embossing is performed in a state of rotating the embossing data by 180 degrees (S36). After having embossed the raised-letter data, the tape feeding by a predetermined length is made and the embossed target tape T is discharged out of the embossed-tape discharging portion 48 (S37).

In other words, as shown in FIG. 10A, the target tape T (T3) which has added thereto the upside-and-downside identifying information D at a left front-end portion is inserted along the lower guide member 66. In case the upside-and-downside identifying information D is detected by the upside-and-downside identifying sensor 69 during the tape feeding by the predetermined length after the front end of the tape has been detected by the front-end detection sensor 68, a judgment is made that the target tape T has been correctly inserted as to the upside-and-downside relationship. The raised-letter data inside the raised-letter emboss-data block 86*c* (see FIG. 6) is read out to thereby perform the embossing of the raised letters from the front-end side of the raised-letter data.

The raised-letter data is, as described above, made up of: the data portion generated for raised-letter B embossing based on the inputted character information (here, "AIU"); and the front waste margin data and the rear waste margin data. Therefore, the expression "to perform embossing of the raised letters B from the front-end side of the raised-letter data (i.e., to perform raised-letter embossing in the positive or normal direction)" means the following. Namely, embossing is performed in the order of: the front waste margin data; the data corresponding to the three embossing points on the left vertical row of the first character (in this example, "A";

see FIG. 4A); the data corresponding to the three embossing points on the right vertical row of the first character (in this example, "A"; the data corresponding to the left vertical row of the second character (in this example, "I"); and so on; finally followed by embossing of the rear waste margin data.

As shown in FIG. 10B, in case the target tape T (T3) which has attached thereto the upside-and-downside identifying information D at the front left end portion (rear right upper end portion in the figure) is inserted along the lower guide member 66 in an inverted state (i.e., upside down), the front end of the tape is detected by the front-end detection sensor 68, but thereafter the upside-and-downside identifying information D cannot be detected by the upside-and-downside identifying sensor 69 during the feeding of the predetermined length of the tape. As a result, it is judged that the target tape T has been inserted upside down and the inverted raised-letter data B' inside the inverted raised-letter emboss-data block 86*c* (see FIG. 6) is read out to thereby perform raised-letter embossing (embossing is performed from the rear-end side of the raised-letter data). The expression "to emboss from the rear-end side of the raised-letter data (i.e., to emboss the raised-letter data in a state of rotating by 180 degrees)" means the following. Namely, embossing is performed in the order of: the rear waste margin data; the data corresponding to the data obtained by rotating by 180 degrees the three vertically arrayed embossing points (FIG. 3A) on the right row of the last character (in this example, "U"); the data corresponding to the data obtained by rotating by 180 degrees the three vertically arrayed embossing points on the left row of the last character (in this example, "U"); the data corresponding to the data obtained by rotating by 180 degrees the three vertically arrayed embossing points on the right row of the last but one character (in this example, "I"); and so on; finally followed by embossing of the front waste margin data.

As described above, the emboss-processing section 3 detects the upside and the downside of the target tape T, and determines the direction of embossing the raised letters based on the result of the detection. Therefore, even if the user wrongly inserts the target tape T upside down, the embossing of the raised letters can be made in the correct direction (i.e., in a state in which the upside and the downside of the target tape T and the upside and the downside of the raised letters B coincide with each other).

Figure 16A:
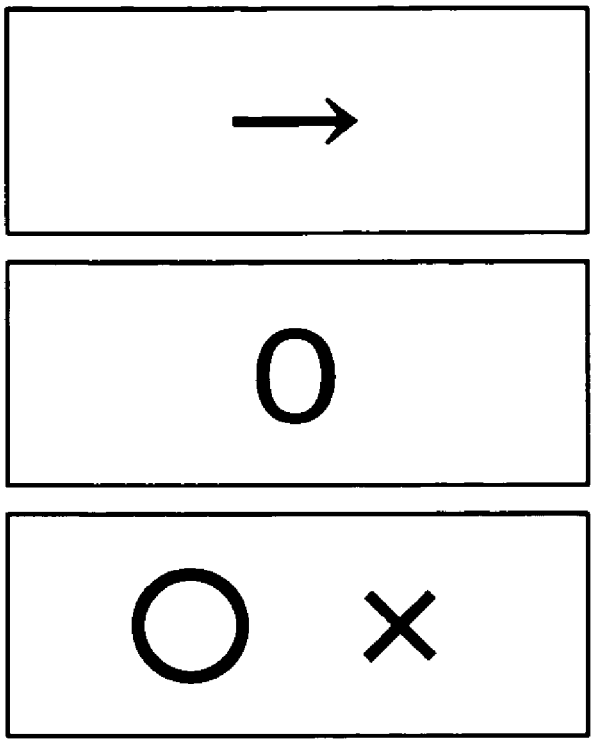
FIGS. 16A and 16B are schematic plan views to show examples in the prior art.
Figure 16B:
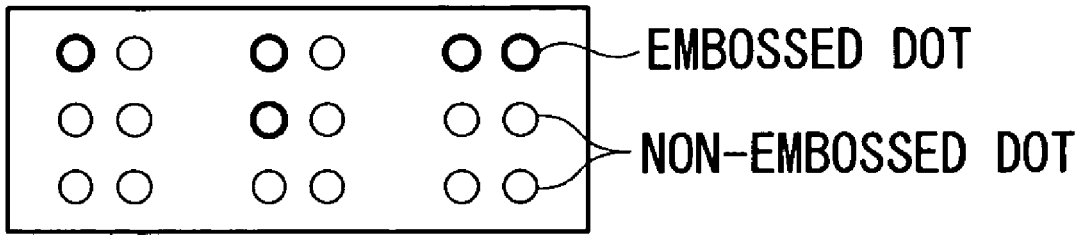

In addition, since the upside-and-downside identifying information D is printed near the front end portion as seen in the feeding direction of the target tape T, the upside and the downside in the widthwise direction of the target tape T can be quickly judged, after detection of the tape front end, by feeding the predetermined length of tape. Further, since the mark is added near the widthwise end portion, the visibility of the printed written-letter data is not impaired. Still furthermore, since the upside and the downside can be judged by the mark, even in case the upside and the downside of the content of the written-letter printing cannot be judged (see FIG. 16A), there is no possibility that the user wrongly inserts the target tape T upside down into the embossing tape inserting portion 47. There is neither the possibility of making a mistake in adhering the formed label to an object of adhesion. The upside-and-downside identifying information D may alternatively be printed near the rear end portion and widthwise upper end portion of the target tape T.

Figure 11A:
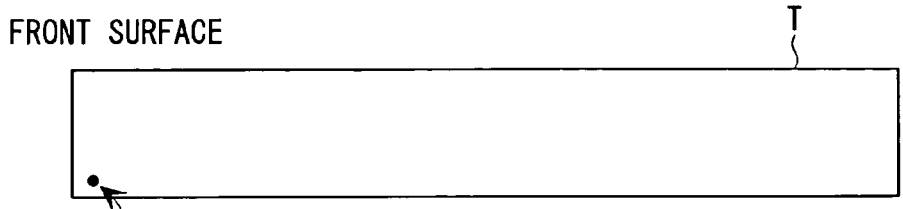
FIGS. 11A through 11F are views showing modified examples of an upside-and-downside identifying information.

With reference to FIGS. 11A through 11F, a description will now be made about modified embodiments of the upside-and-downside identifying information D to be printed by the print-processing section 2. Namely, the upside-and-downside identifying information need not be limited to a black point at the front lower end portion as shown in FIG. 11A, but may be of other forms.

Figure 11B:
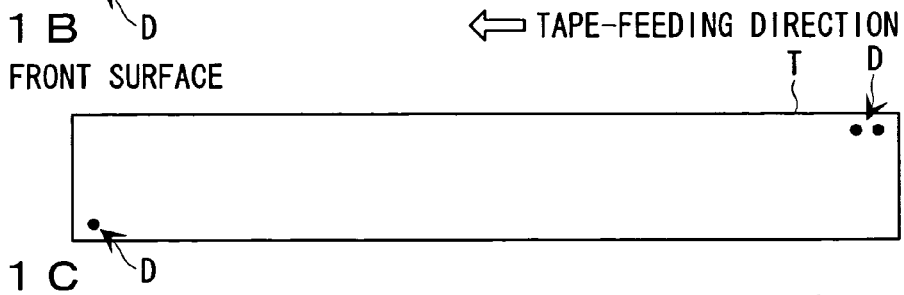

For example, FIG. 11B shows an example in which are printed: one black point at the left lower front end portion; and two points which are horizontally printed in parallel with each other at the right upper rear end portion of the target tape T. By printing different marks at the left lower front end and at the right upper rear end of the target tape T, after having detected the tape front end, the upside and the downside in the widthwise direction of the target tape T can be judged by seeing which of the marks was detected. In other words, after detecting the front end of the tape, the upside and the downside of the target tape T can be quickly judged without waiting for the feeding of the predetermined length which is a result of taking into consideration the detection error.

Figure 11C:
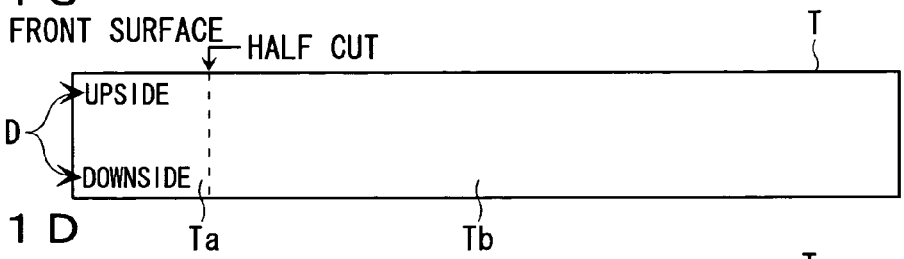

As shown in FIG. 11C, only the recording tape is half-cut or full-cut at the front end portion or the rear end portion, as seen in the feeding direction, of the target tape T. The upside-and-downside identifying information D (in this case, the character information such as "upside" and "downside") is printed on the waste margin Ta that is formed by this half-cutting. Actually, it may be so arranged that the tape is half-cut after having printed the marks. According to this arrangement, the upside-and-downside identifying information D is printed on the waste margin Ta which is provided to facilitate the peeling of the release tape. Therefore, the recording area Tb in which the written-letter printing is performed is not impaired. Still furthermore, by printing the character information as the upside-and-downside identifying information D, the upside and the downside of the tape T can be more easily indicated.

An arrangement may also be made such that the rectangular target tape T having been half-cut or having printed thereon the above-described upside-and-downside identifying information D, is prepared in advance (i.e., the one not processed in the print-processing section 2) so that it can be subjected to the emboss-processing by inserting it into the emboss-processing section 3.

Figure 11D:
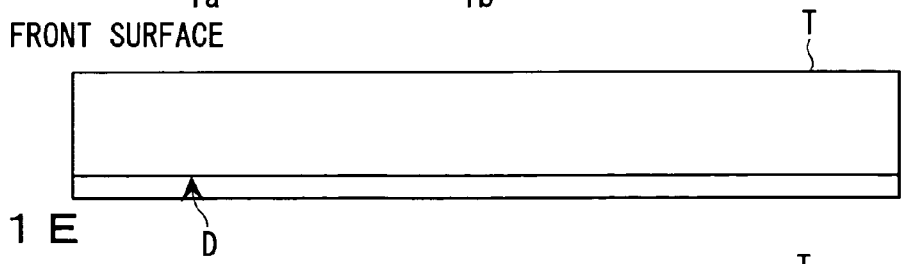

Instead of the examples shown in FIGS. 11A–11C above, the following arrangement may also be employed. Namely, as shown in FIG. 11D, a tape may be employed in which a line parallel with the tape feeding direction is added in advance along an upper end portion or lower end portion of the surface of the target tape T so that the upside and the downside of the tape can be recognized by this line. According to this arrangement, the print-processing of the upside-and-downside identifying information D by the print-processing section 2 can be omitted. Instead of adding a line as illustrated, a predetermined mark may alternatively be added to the tape at an equal pitch.

Figure 11E:
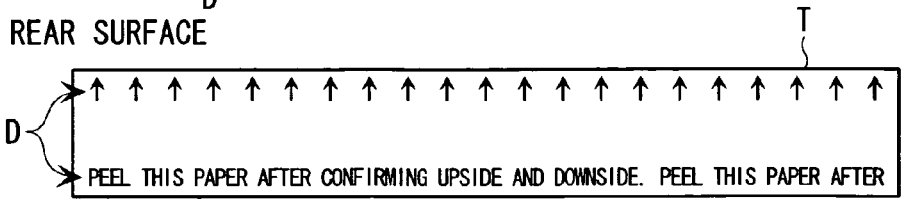

Alternatively, as shown in FIG. 11E, the following arrangement may also be employed. Namely, a message to identify the upside and the downside of the target tape T is printed in advance on the rear surface (i.e., on the release paper) of the target tape T. According to this arrangement, the upside and the downside of the target tape T can be indicated in concrete and easily, and the front surface can be kept intact.

Figure 11F:
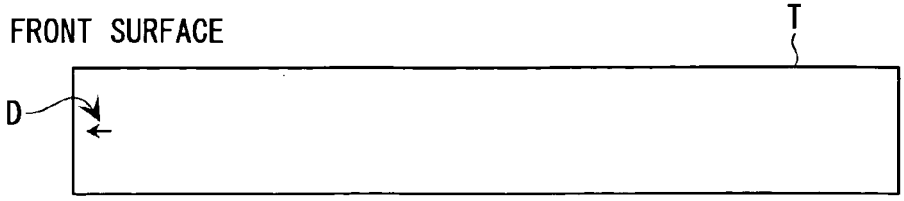

Further, as shown in FIG. 11F, as the upside-and-downside identifying information D, a mark to show the direction of inserting the tape may be printed, instead of the mark to show the upside and the downside thereof. Namely, in the illustrated example, an arrow having a left orientation shows the direction in which the tape is to be inserted. The label forming apparatus 1 according to this embodiment is arranged such that the target tape T shall be inserted thereinto from the right side thereof (see FIG. 1). Therefore, by inserting the target tape T into the label forming apparatus 1 with the front surface of the target tape T facing upward in the direction of the arrow, the target tape T can be inserted in the correct upside-and-downside positional relationship. The mark need not be limited to the arrow, but may be a black point printed at the front end of the tape so as to indicate the direction of insertion. In this arrangement, the upside-and-downside identifying sensor 69 shall preferably be disposed to suit the position of the mark in the widthwise direction of the tape.

The upside-and-downside identifying information D need not be limited to those in the examples shown in FIGS. 11A–11F. Instead, a plurality of options may be stored in the memory (ROM 85, or the like) so that the user can select one of the upside-and-downside identifying information D depending on his or here own liking. It may also be so arranged that the user can set the mode, position, and the number of the upside-and-downside identifying information D using the keyboard 8. In case the widthwise position of the upside-and-downside identifying information D is arranged to be capable of setting by the user, the upside-and-downside identifying sensor 69 must either be disposed in a plurality of numbers or in a manner to be movable in the widthwise direction of the tape.

As described above, according to the first embodiment of this invention, there are performed the printing of the written-letter printing based on the inputted character information and of the upside-and-downside identifying information D to recognize the upside and the downside as seen in the widthwise direction of the target tape T in the print-processing section 2. Therefore, when the target tape T on which the written letters have been printed is inserted into the embossing tape inserting portion 47 for feeding the target tape T into the emboss-processing section 3, the user can confirm the upside-and-downside identifying information D. As a result, there is no possibility of inserting the target tape T upside down. In addition, even in case the upside and the downside of the content of the written-letter printing cannot be judged (e.g., an arrow mark, a numeral zero, or the like), the upside and the downside of the formed label will not be mistaken in adhering it to an object of adhesion.

In the emboss-processing section 3, the upside and the downside as seen in the widthwise direction of the target tape T is detected by the upside-and-downside identifying sensor 69 and, in case the target tape T is inserted upside down, the raised-letter data is embossed in a state of being rotated by 180 degrees. Therefore, even if the target tape T is inserted upside down, the raised-letter embossing can still be performed correctly.

Figure 12:
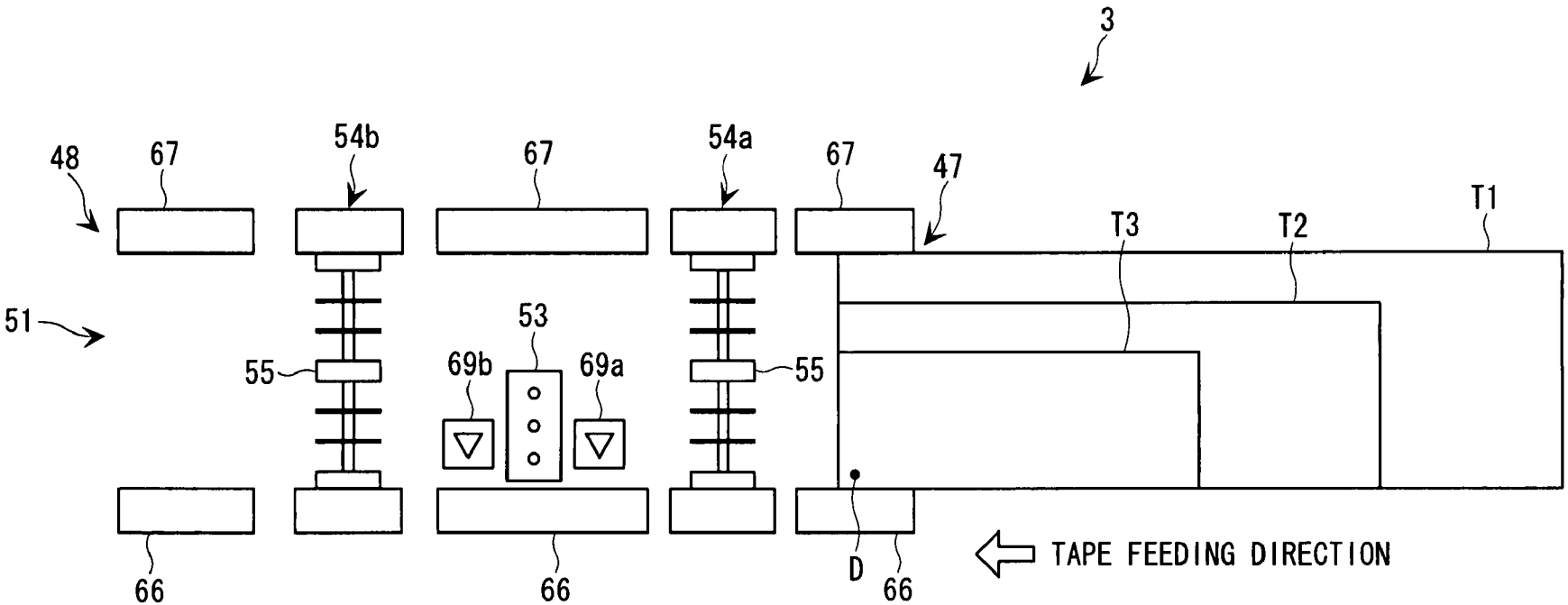
FIG. 12 is a schematic plan view explaining another modified example around the tape traveling passage in the raised-letter embossing section.

In the above-described embodiment, the emboss-processing section 3 is made up, as seen from the side of the embossing tape inserting portion 47, of: the embossing unit 53; the tape feeding mechanism 54; the front-end detection sensor 68; and the upside-and-downside identifying sensor 69 (see FIG. 5). However, as shown in FIG. 12, the upside-and-downside identifying sensor 69 may also be disposed on the upstream side of the embossing unit 53 (as shown by 69*a*), or between the embossing unit 53 and the tape feeding mechanism 54*b* (as shown by 69*b*). In this case, the tape feeding mechanism 54*a* is required on the upstream side of the upside-and-downside identifying sensors 69*a*, 69*b*, because, in a state in which the front end of the tape has not reached the tape feeding mechanism 54*a*, an accurate detection (i.e., recognition of the upside and the downside) cannot be made. By thus arranging the tape feeding mechanism while disposing the upside-and-downside identifying sensor 69 on an upstream side to the best extent possible, the waste margin on the front end can be set shorter. In other words, unlike the example in FIG. 5, it is not always necessary for the length of the front waste margin to be set longer than the length L2.

Further, it is also possible to employ an arrangement in which the front-end detection sensor 68 for detecting the front end of the target tape T is omitted. In this case, it is preferable to employ the following arrangement. Namely, after the user has inserted the target tape T until the front end thereof reaches the tape-feeding mechanism 54*a* or 54*b*, the tape feeding is performed by the depression of the feed-start key. The upside-and-downside identifying information D is detected and, based on the position of detection of this upside-and-downside identifying information D, the raised-letter embossing and subsequent tape feeding shall be performed by the depression by the user of the emboss-start key. Instead of feeding the tape by a predetermined length based on the raised-letter data after having finished the embossing operation, it may be so arranged that the tape-feeding mechanism 54*a* is kept driving while the feed-start key is being depressed by the user so that the target tape T can be discharged. According to this arrangement, the front-end detection sensor 68 can be omitted, resulting in a simpler construction of the apparatus (control system).

The apparatus casing 6 to form the outer shell of the label forming apparatus 1 is arranged to be integrally formed by the front casing 6*a* having the print-processing section 2 and the rear case 6*b* having the emboss-processing section 3 (see FIG. 1). It is also possible to constitute them separately so that they can be connected by an interface (connector). According to this arrangement, only those who need the raised-letter embossing can selectively add the apparatus corresponding to the rear case 6*b*. In addition, this arrangement enables to change the apparatus corresponding to the rear case 6*b* to some other modes. Therefore, the general versatility (or applicability) of the apparatus corresponding to the front case 6*a* (written-letter printing apparatus) can be enhanced.

Each part (function) of the above-described label forming apparatus 1 can be provided in the form of a program. The program may be provided in a state of being stored in a memory medium (not illustrated). As the memory medium, there may be used a CD-ROM, a flash ROM, a memory card (compact flash=reg. TM, a smart media, memory stick, or the like), a compact disc, an opto-magnetic disc, a digital versatile disc, flexible disc, or the like.

Without resorting to the above-described examples, there may be employed a modified example without deviating from the substance of this invention. This invention can be applied not only to the label forming apparatus 1, but also to an apparatus in which the written-letter printing and/or raised-letter embossing can be performed.

With reference to the flow sheet in FIG. 13, a description will now be made about the print-processing/emboss-processing (label forming method) according to a second embodiment of this invention. When the power of the label forming apparatus 1 is switched on by the user, the input/editing program is started up and the input/editing screen (not illustrated) is displayed on the display 12. In this input/editing screen, the user can select a desired processing mode (only written-letter printing, only raised-letter embossing, both written-letter printing and raised-letter embossing). In this embodiment, a selection is made of the mode "both written-letter printing and raised-letter embossing" in which the written letters 89 and the raised letters 65 are printed and embossed on the target tape T of 24 mm wide in two stages in parallel with each other.

Figure 13:
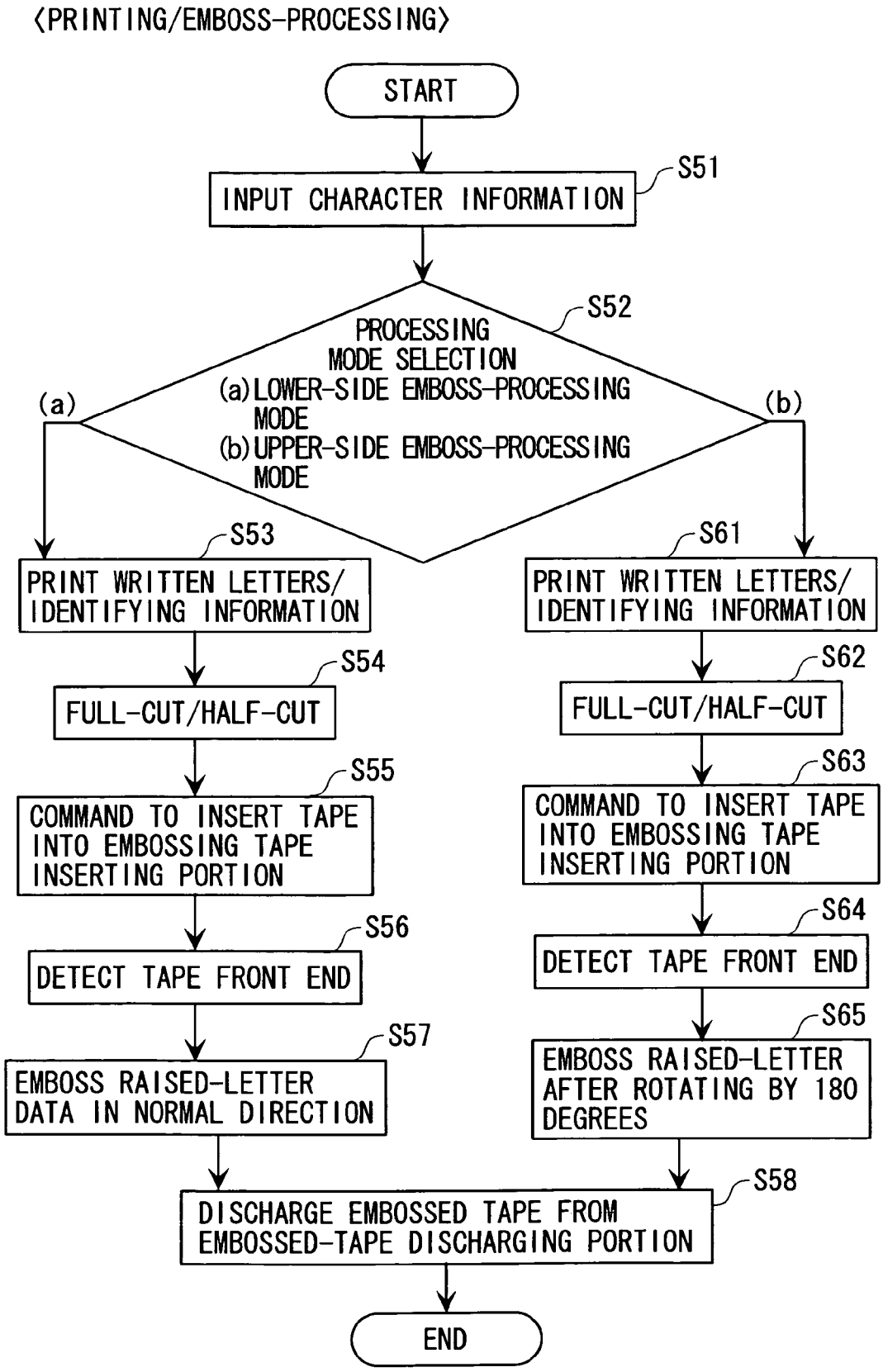
FIG. 13 is a flow chart showing an entire processing of the label forming apparatus according to a second embodiment of this invention.

With reference to FIGS. 13 and 14, a description will now be made about an overall flow of the "both written-letter printing and raised-letter embossing." When the processing of "both written-letter printing and raised-letter embossing" is selected, it becomes possible for the user to input the desired character information into the input and editing screen (S51). After inputting the character information into the input/editing screen, selection is made of an upper and lower layout for a written-letter printing area 93 in which the written letters 89 are printed and a raised-letter embossing area 94 in which the raised letters 65 are embossed (S52). When the user depresses the print/emboss-start key, printing is made of the written letters 89 based on the above-described character information and of the manual-insertion indicating information E which serves as a guide at the time of manually inserting the tape into the emboss-processing section 3 (S53), (S61). The target tape T to be fed faces the cutting section 24, where it is subjected to full cutting and half cutting (S54), (S62) and is discharged out of the print-processing section 2.

Then, the command to insert the tape into the embossing tape inserting portion 47 is displayed on the display 12 (S55), (S63). When the discharged target tape T is manually inserted into the emboss-processing section 3 according to the above-described manual-insertion indicating information E, the emboss-feed motor 57 starts to drive. When the front end of the target tape T to be fed has been detected (S56), (S64), the embossing unit 53 starts to emboss the raised letters 65 with the detection of the front end serving as a trigger (S57), (S65). The target tape T having raised letters 65 embossed thereon is discharged out of the embossed-tape discharging portion 48 (S58).

A description will now be made with reference to FIG. 14 about the layout selection and the determination of the processing mode accompanied thereby. In this layout selection, the user can select one of the following, i.e.: lower-side raised-letter layout (FIG. 14A) in which the upper half of the target tape T is made to be the written-letter printing area 93 and the lower half thereof is made to be the raised-letter embossing area 94; upper-side raised-letter layout (FIG. 14B) in which the lower half of the target tape T is made to be the written-letter printing area 93 and the upper half thereof is made to be the raised-letter embossing area 94. According to this layout selection, since the subsequent control of the written-letter printing and the raised-letter embossing becomes different, the processing of the "both written-letter printing and raised-letter embossing" is provided with the two processing modes of: the lower-side raised-letter processing mode for the lower-side raised-letter layout (i.e., a layout in which the raised letters are laid out on the lower side); and the upper-side raised-letter processing mode for the upper-side raised-letter layout (i.e., a layout in which the raised letters are laid out on the upper side).

In the lower-side raised-letter layout, the raised-letter embossing area 94 of the target tape T to be fed along the tape traveling passage 51 lies this side the tape traveling passage 51 as seen in the widthwise direction of the tape (lower side in the figure), and is coincident with the position of disposing the embossing unit 53. Therefore, the user may manually insert the target tape T into the emboss-processing section 3 in the same direction as the printing direction in the print-processing section 2. When the lower-side raised-letter layout has been selected, the control section 75 (input/editing program) automatically transfers the "both written-letter printing and raised-letter embossing" to the lower-side raised-letter processing mode (S52; (a)). In the lower-side raised-letter processing mode, the written letters 89 are printed in the order of their reading based on the character information and also the manual indication information E is printed on the front-end side waste margin Ta as seen in the tape-feeding direction (FIG. 14A).

In the upper-side raised-letter layout, on the other hand, the raised-letter embossing area 94 of the target tape T to be fed along the tape traveling passage 51 lies on the far side as seen in the widthwise direction of the target tape T (upper side in the figure), which is the opposite to the position of disposing the embossing unit 53. Therefore, the user must manually insert the target tape T which is inversed in the right-and-left direction. Therefore, when the user has selected the upper-side raised-letter layout, the control section 75 automatically transfers the "both written-letter printing and raised-letter embossing" to the upper-side raised-letter processing mode in which the raised letters 65 are embossed on the upper half (S52: (*b*)). In the above-described upper-side raised-letter processing mode, the written letters 89 are printed in the order of their reading based on the character information, and the manual-insertion indicating information E is printed on the waste margin Ta on the base (rear) side as seen in the paying direction of the target tape T.

The target tape T to be processed in the above-described both processing modes (S52: (*a*), (*b*)) is then formed, after full-cutting and half-cutting (S54, S62), into an elongated rectangle as shown in FIGS. 14A, 14B. In this case, in the lower-side raised-letter processing mode, the half-cutting is performed on the front-end side as seen in the direction of feeding the target tape T. In the upper-side raised-letter processing mode, on the other hand, the half-cutting is performed on the rear-end side as seen in the direction of feeding the tape. FIG. 14A shows the state of the target tape T after full-cutting and half-cutting in the lower-side raised-letter processing mode (S54), and FIG. 14B shows the state of the target tape T after full-cutting and half-cutting in the upper-side raised-letter processing mode (S62).

Figure 14A:
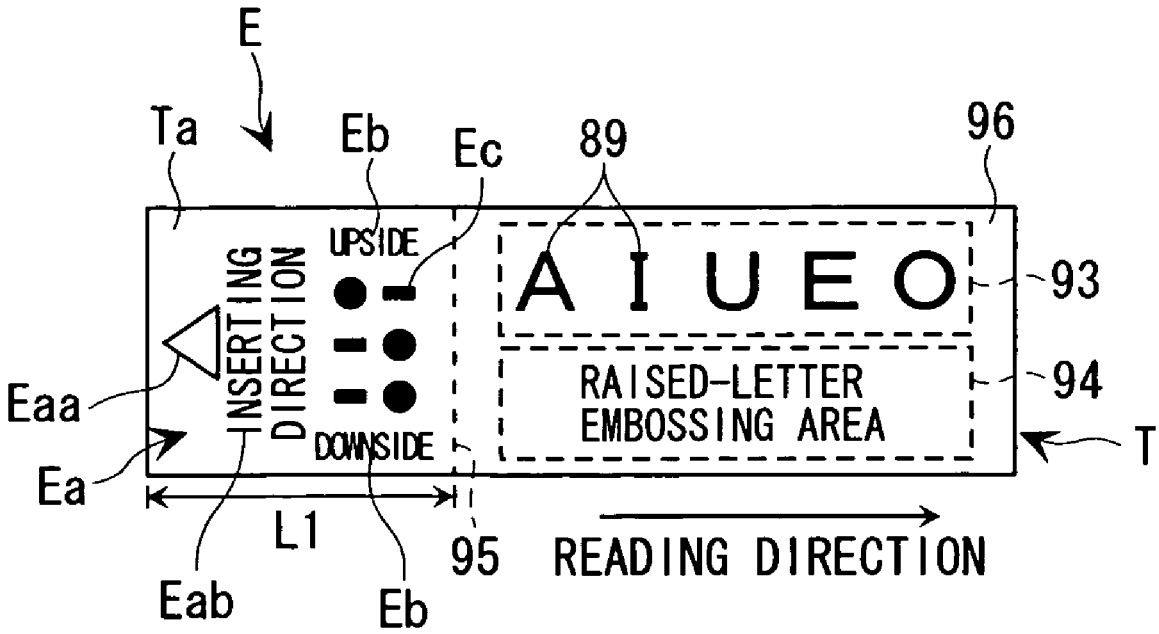
FIG. 14A is a plan view of the target tape to be processed in a lower-side emboss-processing mode and FIG. 14B is a plan view of the target tape to be processed in an upper-side emboss-processing mode.

The target tape T shown in FIG. 14A has a waste margin Ta formed by half-cutting on the front-end side as seen in the direction of manual insertion (on the left side in the figure). The above-described manual-insertion indicating information E is printed on the waste margin Ta. On the succeeding right side, as seen in the figure, there is formed the written-letter printing area 93 where the written letters 89 (characters) are printed based on the input information. On the lower side of this written-letter printing area 93, there is formed the raised-letter embossing area 94. In a border portion between the manual-insertion indicating information E and both the areas 93/94, there is formed a half-cut line 95 which is used in cutting only the recording tape 42 by the half cutter 23. This half-cut line serves to separate the label portion 96 in which the raised letters are embossed after the written letters have been printed, from the waste margin Ta in which the manual-insertion indicating information E is printed.

The manual-insertion indicating information E is made up of: indication information Ea having a triangular arrow Eaa (looking to the left in the figure) indicating the direction of manual insertion into the emboss-processing section 3 and characters for "inserting direction" Eab; upside-and-down-side indicating information Eb showing the upside-and-downside positional relationship of the raised letters 65 to be embossed by the emboss-processing section 3; and raised-letter image information Ec which is an image resembling the raised letters 65. In the indicating information E of this embodiment, the arrow Eaa is essential, but the characters for "inserting direction" and raised-letter image information Ec may be omitted.

Figure 14B:
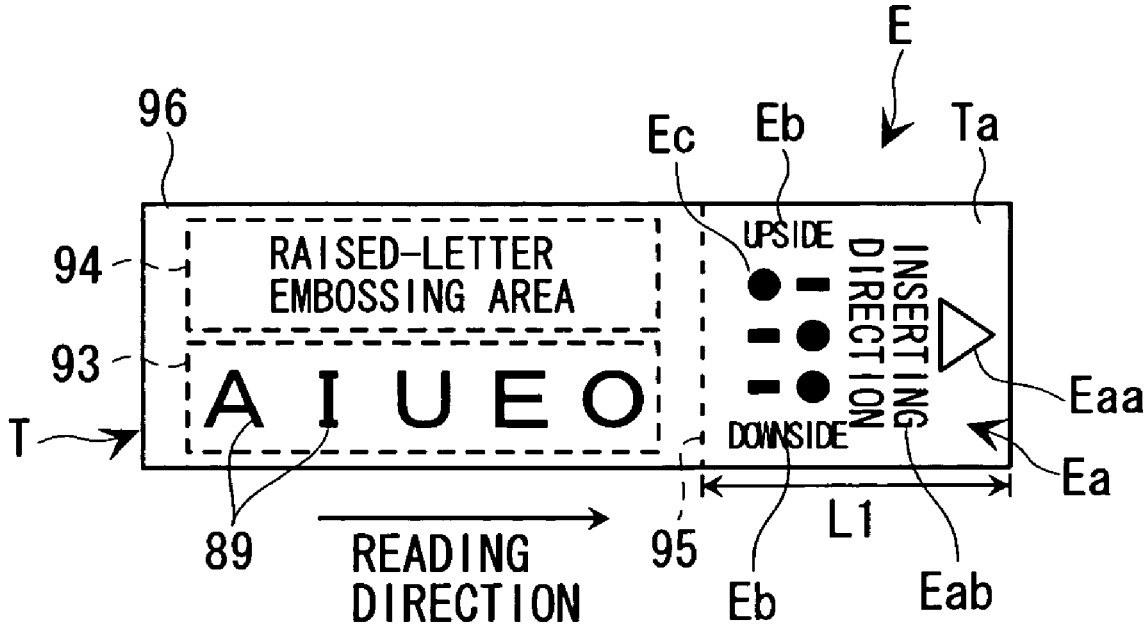

The upside-and-downside indicating information Eb is made up of written letters of "upside" and "downside" respectively disposed on a widthwise outside of the target tape T (see FIGS. 14A and 14B). These written letters "upside" and "downside" are printed in the same direction as the written letters 89 and raised letters 65 which are inputted by the user in both the lower-side raised-letter processing mode and the upper-side raised-letter processing mode.

The raised-letter image information Ec is an image represented in a similar manner as the raised letters corresponding to the written letter "SA" in Japanese hiragana.

The waste margin Ta is not used as a label and, therefore, when the label portion 96 is adhered to an object of adhesion, this waster margin Ta offers a key or clue in peeling the label portion 96 of the recording tape 42 off from the peeling tape 43. The length L1 of the waste margin Ta is arranged to be the same as the distance L1 between the embossing unit 53 and the front-end detection sensor 68 (see FIG. 15). It is thus so arranged that the raised-letter embossing can be started without feeding the manually inserted target tape T in the reverse direction.

The target tape T shown in FIG. 14B has formed a waste margin Ta on the right side as seen in the figure and the manual-insertion indicating information E is printed thereon. On that left side, as seen in the figure, of the target tape T which precedes the waste margin Ta, there is formed the written-letter printing area 93 and the written letters are printed thereon. A raised-letter embossing area 94 is formed on the upper side of the written-letter printing area 93. On the border portion between the manual-insertion indicating information E and both the areas 93/94, there is formed a half-cutting line 95 so that the label portion 96 and the waste margin Ta can be separated apart thereby. The indicating information Ea is printed in a reverse direction in the back-and-forth direction (i.e., in the right direction as seen in the figure).

With reference to FIGS. 15A and 15B, a description will now be made again about the print-processing and emboss-processing. When the target tape T has been discharged as described above, a command is displayed on the display 12 to urge the user to manually insert the target tape T into the embossing tape inserting portion 47 (S55), (S63). The user will the follow this command and manually insert the target tape T as formed above. The user will thus manually insert the target tape T into the embossing tape inserting portion 47 in the same direction as is indicated by the indicating image Ea (i.e., the direction of discharging out of the print-processing section 2 in the lower-side raised-letter processing mode; the direction in which the upside and the downside of the written letters 89 remain as they are: see FIG. 15A), and in the direction opposite to the direction of discharging out of the print-processing section 2 in the upper-side raised-letter processing mode (i.e., in the opposite direction in which the raised letters are represented upside down: see FIG. 15B).

Then, with the insertion by the user of the target tape T serving as a trigger, the tape-feeding mechanism 54 is started up to thereby detect the feeding of the target tape T and the front end of the target tape T by the front-end detection sensor 68 (S56), (S64). With the detection of the front end, the embossing unit 53 recognizes the position of starting the embossing of the raised letters 65 and starts embossing of the raised letters 65 corresponding to the character information from the end of the label portion 96 (raised-letter embossing area 94) beyond the waste margin Ta. In this case, since the length of the waste margin Ta is made to be the distance between the front-end detection sensor 68 and the embossing unit 53, the embossing of the raised letters will be started from the end of the raised-letter embossing area 94.

The embossing of the raised letters 65 is performed, in the upper-side raised-letter processing mode, in the normal direction (i.e., in the direction of reading) (S57) and, in the lower-side raised letter processing mode, in the direction opposite to the direction of reading, i.e., embossing is made of the raised letters 65 which are turned by 180 degrees (S65). The target tape T thus formed is discharged out of the embossed-tape discharging portion 48 (S58), thereby finishing the print-processing and the emboss-processing. The raised letters 65 which are turned by 180 degrees may be stored in advance in the RAM 86 or may be subjected to turn-processing in the CPU 84. According to the above-described print-processing and the emboss-processing, there is formed a target tape T in which the lower-half or the upper-half is subjected to embossing of the raised letters 65. The user may then use the label portion 96 of this target tape T by adhering to an object of adhesion. In case the label portion 96 is adhered, the upside-and-downside indicating information Eb and the raised-letter image information Ec may be taken into consideration to thereby prevent the wrong adhesion.

According to the second embodiment, since there is employed the two-pass system in which the print-processing section 2 and the emboss-processing section 3 are separately provided, the target tape T can be prevented from getting out of position from the printing head 26 due to the embossing vibrations accompanied by the embossing operation, or the quality of the written-letter printing can be prevented from getting deteriorated. In addition, since the target tape T has printed thereon the indicating information Ea to indicate the direction of manual insertion (manual-insertion indicating information E), the user can manually insert the target tape T into the emboss-processing section 3 without mistaking the direction of manual insertion. Further, since the manual-insertion indicating information E is printed on the waste margin Ta which is formed by half cutting at the front end portion as seen in the direction of manual insertion, the indicating image will not remain in the label portion 96. This arrangement makes it possible to more clearly indicate the direction of manual insertion at the front end portion as seen in the direction of manual insertion.

The label forming apparatus according to this embodiment is provided with a half cutter, but it may be omitted. In the arrangement without the half cutter, the arrow Eaa or information corresponding thereto (preferably, less remarkable one) may be printed on he label portion. In addition, in this embodiment, the waste margin Ta is formed at the front end side as seen in the direction of manual insertion. It may, alternatively, be formed at the base (rear) side as seen in the direction of manual insertion.

Still furthermore, in this embodiment, there may be formed a label in which only the raised letters are embossed on two stages. In other words, after embossing the raised letters, the target tape T is put upside down for subsequent manual insertion thereof into the emboss-processing section, thereby embossing the raised letters on two stages. In this case, since the raised letters that have been formed earlier pass through the inner three annular grooves of the driven roller, they are prevented from being damaged or crushed.

What is claimed is:

1. A tape processing apparatus comprising:

a print-processing section having printing means for printing written-letter data on a target tape based on inputted character information; and an emboss-processing section into which is manually inserted the target tape upon print-processing, said emboss-processing section having embossing means for embossing raised-letter data on the target tape based on the character information, wherein said printing means prints on the target tape upside-and-downside identifying information for identifying an upside and a downside of the target tape as seen in the widthwise direction thereof, and wherein said emboss-processing section comprises:

information detection means for detecting the up-and-down identifying information of the inserted tape;

upside-and-downside distinguishing means for distinguishing the upside and the downside of the target tape depending on a result of detection by said information detection means; and emboss-controlling means for controlling said embossing means, when the target tape is distinguished by said upside-and-downside distinguishing means to have been inserted upside down, to emboss the raised-letter data in a state of turning by 180 degrees.

2. The apparatus according to claim 1, wherein the target tape is made up of a recording tape having coated an adhesive agent on a rear surface thereof, and a release tape having adhered to the rear surface of the recording tape through the adhesive agent, wherein said print-processing section further comprises: full-cut means for full-cutting the target tape; and half-cut means for half-cutting only the recording tape of the target tape, and wherein said printing means prints the upside-and-downside identifying information at a waste margin of the target tape, said waste margin being formed by said half-cut means.

* * * * *